United States Patent [19]

Omori et al.

[11] Patent Number: 4,593,664

[45] Date of Patent: Jun. 10, 1986

[54] FUEL INJECTION APPARATUS

[75] Inventors: Toshihiko Omori, Nagoya, Japan; Shuzi Sakakibara, Rancho Palos Verdes, Calif.; Masaaki Kato, Kariya; Akira Masuda, Aichi, both of Japan

[73] Assignee: Nippondenso Co., Ltd., Kariya, Japan

[21] Appl. No.: 770,092

[22] Filed: Aug. 28, 1985

[30] Foreign Application Priority Data

Sep. 4, 1984 [JP] Japan ..... 59-184919
Oct. 8, 1984 [JP] Japan ..... 59-212275

[51] Int. Cl.[4] ..... F02M 39/00

[52] U.S. Cl. ..... 123/446; 123/500; 239/95

[58] Field of Search ..... 123/446, 500, 501, 447, 123/458; 239/88-95

[56] References Cited

U.S. PATENT DOCUMENTS

| | | | |
|---|---|---|---|
| 4,385,609 | 5/1983 | Kato | 123/446 |
| 4,396,151 | 8/1983 | Kato | 123/446 |
| 4,425,894 | 1/1984 | Kato | 123/446 |
| 4,485,787 | 12/1984 | Kato | 123/446 |
| 4,537,352 | 8/1985 | Kato | 123/446 |

FOREIGN PATENT DOCUMENTS

| | | | |
|---|---|---|---|
| 58-128462 | 8/1983 | Japan | 123/446 |
| 0217758 | 12/1983 | Japan | 123/446 |
| 0222969 | 12/1983 | Japan | 123/446 |
| 0039962 | 3/1984 | Japan | 123/446 |
| 0093930 | 5/1984 | Japan | 123/446 |

*Primary Examiner*—Carl Stuart Miller
*Attorney, Agent, or Firm*—Cushman, Darby & Cushman

[57] ABSTRACT

The fuel injection apparatus of the invention comprises a unit injector for injecting fuel to a combustion chamber of an internal combustion engine. An injection pump chamber and a timing chamber are defined in the unit injector, a quantity of fuel, adjusted in accordance with a drive condition of an engine, being supplied to these chambers. Fuel in the injection pump chamber and the timing chamber can be pressurized by an injection plunger and a timing plunger operated by pressure from the same pressure source. When the fuel in the injection pump chamber is pressurized to a predetermined injection pressure, fuel in the injection pump chamber is injected to the corresponding combustion chamber of the engine. The timing chamber is connected to a relief path, and a check valve, which can be opened at a pressure lower than the injection pressure, is provided in the relief path.

15 Claims, 21 Drawing Figures

FUEL INJECTION APPARATUS

BACKGROUND OF THE INVENTION

The present invention relates to a fuel injection apparatus for supplying fuel to a combustion chamber of an internal combustion engine and, more particularly, to a fuel injection apparatus suitable for a diesel engine.

A fuel injection apparatus of this type comprises a fuel supply pump such as a fuel injection pump and a unit injector coupled to the pump. The unit injector, which receives fuel from the fuel supply pump, has an injection plunger driven synchronously with the engines operation, and an injection chamber defined by the injection plunger. Thus, the unit injector can high-pressurize fuel from the fuel injection pump so as to inject it into the combustion chamber. Since the fuel injection apparatus of this type can inject fuel at high pressure into the combustion chamber of the engine, it is very suitable for a diesel engine requiring high pressure fuel injection.

In the fuel injection apparatus applied to a diesel engine, high-pressure fuel must be injected into the combustion chamber, and the quantity and timing of the fuel injection must be controlled in accordance with engine operation conditions. For this reason, a control means for controlling the injection quantity and timing of fuel is adopted in the fuel injection apparatus. For example, a known control means comprises a relief path for coupling the injection chamber of the unit injector with a fuel tank, and a single solenoid valve provided in the relief path. With the control means, timing for pressurizing fuel in the injection chamber, i.e., an injection timing, can be controlled when the relief path is closed under the control of the solenoid valve. Conversely, when the opening of the relief path is controlled by the solenoid valve, an fule injection end timing, i.e., a fuel injection quantity, can be controlled. However, when the fuel injection timing and quantity are controlled by the above-mentioned single solenoid valve, a high fuel pressure applies pressure on the solenoid valve while the fuel injection apparatus is operative. For this reason, the solenoid valve is easily damaged by the high fuel pressure, adversely affecting the precision with which the open/close operation can be performed and, similarly, hindering the precision with which both fuel injection quantity and timing can be controlled. Yet, when the injection pressure of fuel is decreased to protect the solenoid valve, the desired high-pressure injection cannot be performed.

SUMMARY OF THE INVENTION

It is an object of the present invention to provide a fuel injection apparatus which can perform high-pressure fuel injection, and in which a fuel injection quantity and timing can be controlled in accordance with the engines operating conditions, resulting in high reliability of operation.

The object of the present invention can be achieved by a fuel injection apparatus for supplying fuel from a fuel tank to a combustion chamber of an internal combustion engine, the fuel injection apparatus comprising:

an injector housing defining a pressure cylinder bore, an injection cylinder bore and a timing cylinder bore respectively connected in series with the pressure cylinder bore;

a pressure plunger, fitted in the pressure cylinder bore and having one end, defining in the pressure cylinder bore a pressure pump chamber communicating with the injection cylinder bore and the timing cylinder bore;

first fuel supply means for supplying fuel from the fuel tank to the pressure pump chamber;

pressurizing means for reciprocating the pressure plunger in the pressure cylinder bore in synchronism with the engine's operation so as to pressurize fuel in the pressure pump chamber;

an injection plunger, having a diameter smaller than the pressure plunger, fitted in the injection cylinder bore and having two ends, defining in the injection cylinder bore an injection pump chamber and a first communicating chamber communicating with the pressure pump chamber;

second fuel supply means for adjusting the quantity of fuel from the fuel tank in accordance with the engine's operating conditions so as to supply the adjusted fuel quantity to the injection pump chamber;

injection valve means for injecting the fuel into the injection pump chamber toward a combustion chamber of the engine when the pressure in the pressure pump chamber is applied to the injection plunger through the first communicating chamber, and the fuel pressure in the injection pump chamber reaches a predetermined injection pressure;

a timing plunger fitted in the timing cylinder bore and having two ends, defining, in the timing cylinder bore, a timing chamber and a second communicating chamber communicating with the pressure pump chamber;

third fuel supply means for adjusting the quantity of fuel from the fuel tank in accordance with the engine's operating conditions so as to supply the adjusted fuel quantity to the timing chamber; and relief means for relieving the fuel in the timing chamber, the relief means having a relief path coupled to the timing chamber and a relief valve, disposed in the relief path, for opening the relief path when the pressure in the pressure pump chamber is applied to the timing plunger through the second communicating chamber, and the fuel pressure in the timing chamber reaches a predetermined relief pressure by the timing plunger, the relief pressure being set lower than the injection pressure.

According to the fuel injection apparatus of the present invention, when fuel in the pressure pump chamber is pressurized by the pressure plunger, the pressure in the pressure pump chamber is applied to both the injection plunger and the timing plunger. Thus, the fuel in the injection chamber is pressurized by the injection plunger, and the fuel in the timing chamber is pressurized by the timing plunger. In this case, since the relief pressure or the valve opening pressure of the relief valve is set lower than that of the injection valve means, when the fuel in the injection pump chamber and the timing pump chamber is pressurized, the relief valve is first opened before the injection valve means is opened. For this reason, the timing plunger is moved to the timing chamber side upon application of the pressure in the pressure pump chamber, and the fuel in the timing chamber is discharged through the relief path and the relief valve upon movement of the timing plunger. When the fuel in the timing chamber is discharged, the pressure in the pressure pump chamber is kept constant, and the injection plunger is not moved by the pressure of the pressure pump chamber. Thereafter, when the fuel supplied in the timing chamber is completely discharged, the timing plunger can no longer be moved by the pressure of the pressure pump chamber. Therefore, at this time, the fuel pressure in the pressure pump chamber is further increased and the fuel pressure in the injection pump chamber is further pressurized by the injection plunger. When the pressure in the injection pump chamber reaches the valve opening pressure of the injection valve means, the fuel in the injection pump chamber begins to be injected into the combustion chamber of the engine through the injection valve means and, at the same time, the injection plunger is moved, in accordance with this injection, by the pressure in the pressure pump chamber. When the fuel in the injection pump chamber has been completely injected, fuel injection is completed, since the injection plunger can no longer be moved by the pressure in the pressure pump chamber.

According to the fuel injection apparatus of the present invention, the fuel injection quantity is determined by the fuel quantity supplied in the injection pump chamber. As for the fuel injection timing, since fuel injection is performed, in practice, after completely discharging the fuel supplied to the timing chamber, the fuel injection timing can be controlled by adjusting the fuel quantity supplied to the timing chamber.

As described above, the fuel injection quantity and timing can be controlled by adjusting the fuel quantity supplied to the injection pump chamber and the timing chamber by the second and third fuel supply means, respectively. For this reason, in order not to apply the high fuel pressure of the injection pump chamber to the second fuel supply means side, a check valve can, for example, be disposed between the injection pump chamber and the second fuel supply means, and the second fuel supply means can be protected from the high pressure in the injection pump chamber. On the other hand, since the pressure in the timing chamber does not become as high as that in the injection pump chamber, the third fuel supply means need not be protected from the pressure in the timing chamber. However, if needed, the third fuel supply means can be protected from the pressure in the timing chamber by using a check valve in the same manner as in the second fuel supply means.

DETAILED DESCRIPTION OF THE PREFERRED EMBODIMENTS

Figure 1:
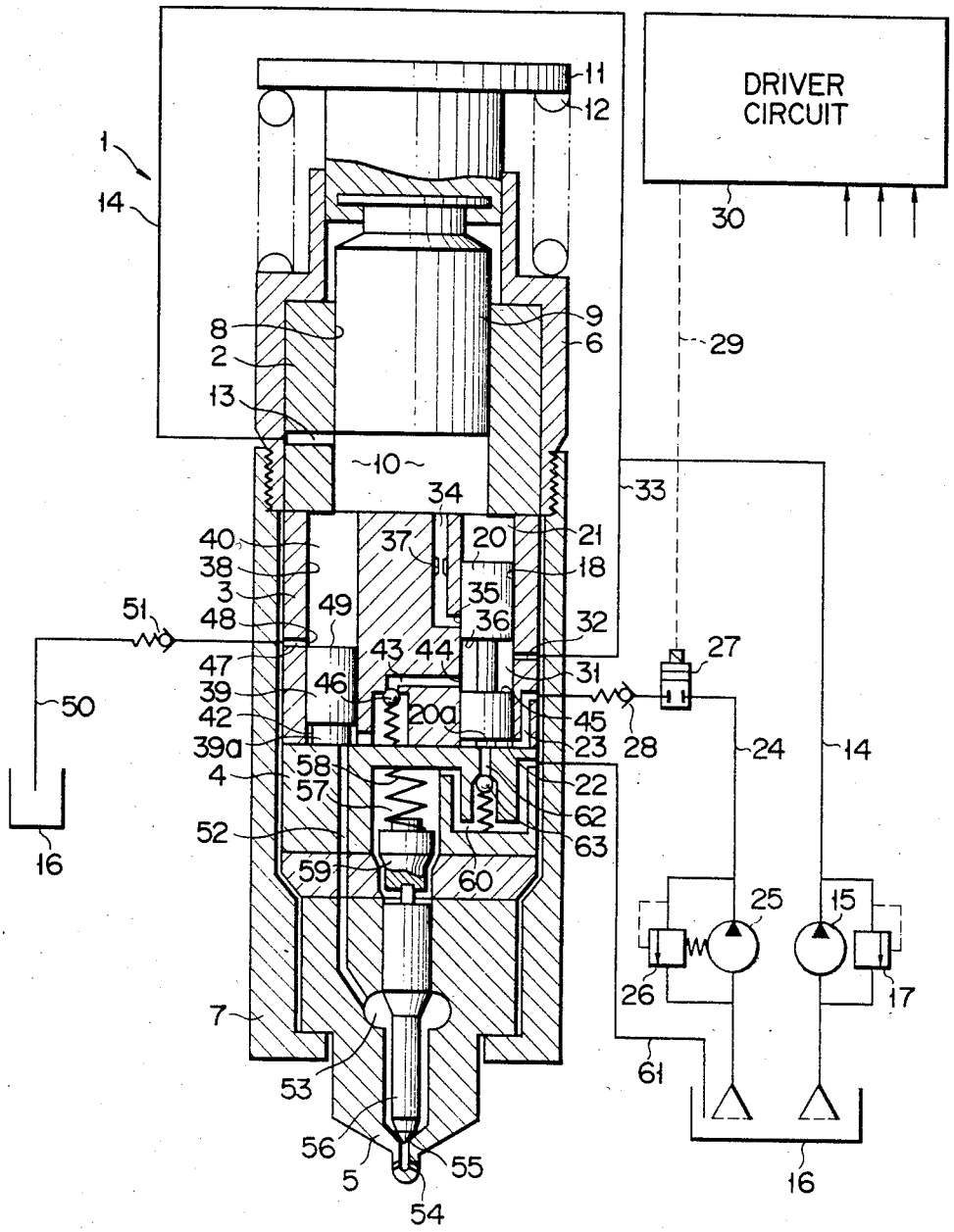
FIG. 1 is a sectional view showing a unit injector of a fuel injection apparatus according to a first embodiment of the present invention, together with a hydraulic circuit.

FIG. 1 shows a fuel injection apparatus according to a first embodiment of the present invention. The apparatus comprises a unit injector 1 for injecting high-pressure fuel into a combustion chamber of a diesel engine. The injector 1 has a pressure cylinder body 2, an injection cylinder body 3, a nozzle holder body 4 and a nozzle body 5, viewed from the top of FIG. 1. The bodies 2 to 5 are coupled integrally with each other by a holder nut 6 and a retaining nut 7.

A cylinder bore 8 is coaxially formed in the body 2. A pressure plunger 9 is fitted in the bore 8, and a pressure pump chamber 10 is defined by the lower end face of the plunger 9 and the upper end face of the body 3 in FIG. 1. The upper end of the plunger 9 projects upward from the body 1 and is coupled to a cam follower 11. A return spring 12 is disposed between the cam follower 11 and the nut 6, and urges the cam follower 11 upward, as shown in FIG. 1. The cam follower 11 is pressed downward by a cam (not shown) driven in synchronism with the engine's operation. Therefore, the plunger 9 is reciprocated in the bore 8 by the operation of the cam follower 11, the spring 12 and the cam in synchronism with the engine's operation. A connecting hole 13 is formed in the body 2, and is opened by the lower end face of the plunger 9 when the plunger 9 is moved near the top dead center, thereby communicating with the chamber 10. The hole 13 is connected to a fuel supply pump 15 through a supply path 14. The pump 15 draws fuel from a fuel tank 16, and supplies fuel to the path 14. A relief valve 17 is provided in a path for bypassing the pump 15. The valve 17 adjusts the pressure of the fuel supplied from the pump 15.

A timing cylinder bore 18 extending in the axial direction is formed in the body 3. The upper end of the timing cylinder bore 18 communicates with the chamber 10 in FIG. 1. A timing plunger 20 having a diameter smaller than that of the plunger 9 is fitted in the bore 8. A communicating chamber 21 communicating with the chamber 10 is defined in the bore 18 by the upper end of the plunger 20. In the bore 18, a timing chamber 22 is defined by the lower end of the plunger 20 and the upper end face of the body 4. A projection 20*a* is formed at the lower end of the plunger 20.

In the body 3, a fuel introduction hole 23 having an open end at the lower end of the chamber 22 is formed. The other end of the hole 23 is connected to another fuel pump 25 through a pressure path 24. The pump 25 also draws fuel from the tank 16 and supplies it to the path 24. A relief valve 26 is provided in a path for bypassing the pump 25 so as to adjust the pressure of fuel supplied from the pump 25 at a constant level. It should be noted that the pressure of fuel supplied from the pump 25 is set so as to be greater than that supplied from the pump 15. A solenoid operated valve 27 is provided in the path 24 so as to open/close the path 24. Furthermore, a timing check valve 28 is located between the hole 23 and the valve 27 so as to prevent a fuel flow from the chamber 22 to the valve 27. The valve 27 is connected to a driver circuit 30 through a signal line 29. The circuit 30 receives signals from various sensors (not shown), such as sensors for detecting engine speed and load, and generates a control signal for actuating the valve 27 in accordance with the signals.

An annular groove 31 is formed at a central portion of the plunger 20. A communicating hole 32 having one end communicating with the groove 31 is formed in the body 3. The other end of the hole 32 is connected to the path 14, i.e., the low pressure side fuel supply pump 15 through a branch path 33. A bypass hole 34 having one end communicating with an inner peripheral surface of the bore 18 and the other end connected to the chamber 10 is formed in the body 3. In the hole 34, a port 35 opened in the inner surface of the bore 18 is opened/-closed by an upper annular surface 36 defining the groove 31 of the plunger 20. More specifically, when the timing plunger 20 is moved upward from the bottom dead center in FIG. 1, the port 35 of the hole 34 is opened by the surface 36 of the plunger 20. Furthermore, a restrictor 37 is formed in the middle of the hole 34.

An injection cylinder bore 38 is formed in the body 3 parallel to the bore 18. In FIG. 1, the upper end of the bore 38 communicates with the chamber 10 in the same manner as the bore 18. An injection plunger 39 having a diameter smaller than that of the plunger 9 is fitted in the bore 38. In the bore 38, a communicating chamber 40 communicating with the chamber 10 is defined by the upper end face of the plunger 39, and an injection pump chamber 42 is defined by the lower end portion of the plunger 39 and the upper end face of the body 4.

An adjusting hole 43 having one end communicating with the lower portion of the chamber 42 is formed in the body 3. The other end of the hole 43 is open to the inner peripheral surface of the bore 18. An adjusting port 44 of the hole 43 communicates with the groove 31 when the plunger 20 is at the bottom dead center. However, when the plunger 20 is moved upward in FIG. 1, the port 44 is closed by another, i e., lower annular surface 45 defining the groove 31. An adjusting check valve 46 is inserted midway along the hole 43. The valve 46 prevents fuel from flowing from the chamber 42 toward the groove 31.

A relief hole 47 having one end (port) 48 open in the inner peripheral surface of the bore 38 is formed in the body 3. The port 48 of the hole 47 communicates with the chamber 40 when the plunger 39 is positioned at the bottom dead center. When the plunger 39 is moved upward from the bottom dead center, the port 48 is closed by an upper end face 49 of the plunger 39. The other end of the hole 47 is connected to the tank 16 through a path 50, and a check valve 51 is inserted midway along the path 50.

A fuel injection passage 52 formed in the bodies 4 and 5 is connected to the chamber 42. Midway along the passage 52, a fuel reservoir 53 is defined, and the passage 52 communicates with a plurality of injection holes 54 formed at a distal end of the body 5.

Furthermore, a valve hole 55 is formed in the passage 52 positioned between the reservoir 53 and the holes 54, and can be opened/closed by a nozzle needle 56 disposed in the body 55. Referring to FIG. 1, the upper end of the needle 56 projects into a spring chamber 57 defined in the body 4. In the chamber 57, a pressure spring 58 is housed. The pressure spring 58 biases the nozzle needle 56 downward in FIG. 1 through a pressure pin 59. Therefore, the nozzle needle 56 closes the valve hole 55, i.e., the holes 54 by the biasing force of the pressure spring 58.

A relief hole 60 communicating with the chamber 58 is formed in the body 4. The other end of the hole 60 is connected to the tank 16 through a path 61.

A timing hole 62 for connecting the hole 60 and the chamber 22 is formed in the body 4. Midway along the timing hole 62, a timing relief valve 63 is inserted. The valve 63 allows a fuel flow from the chamber 22 to the tank 16 side.

However, it should be noted that the valve opening pressure of the valve 63 is set so as to be higher than the fuel pressure supplied from the pump 25. Needless to say, the valve opening pressure of the needle 56, determined by the biasing force of the pressure spring 58, is set so as to be sufficiently greater than that of the valve 63.

The operation of the fuel injection apparatus of the first embodiment will be described with reference to FIGS. 2 to 7.

Figure 2:
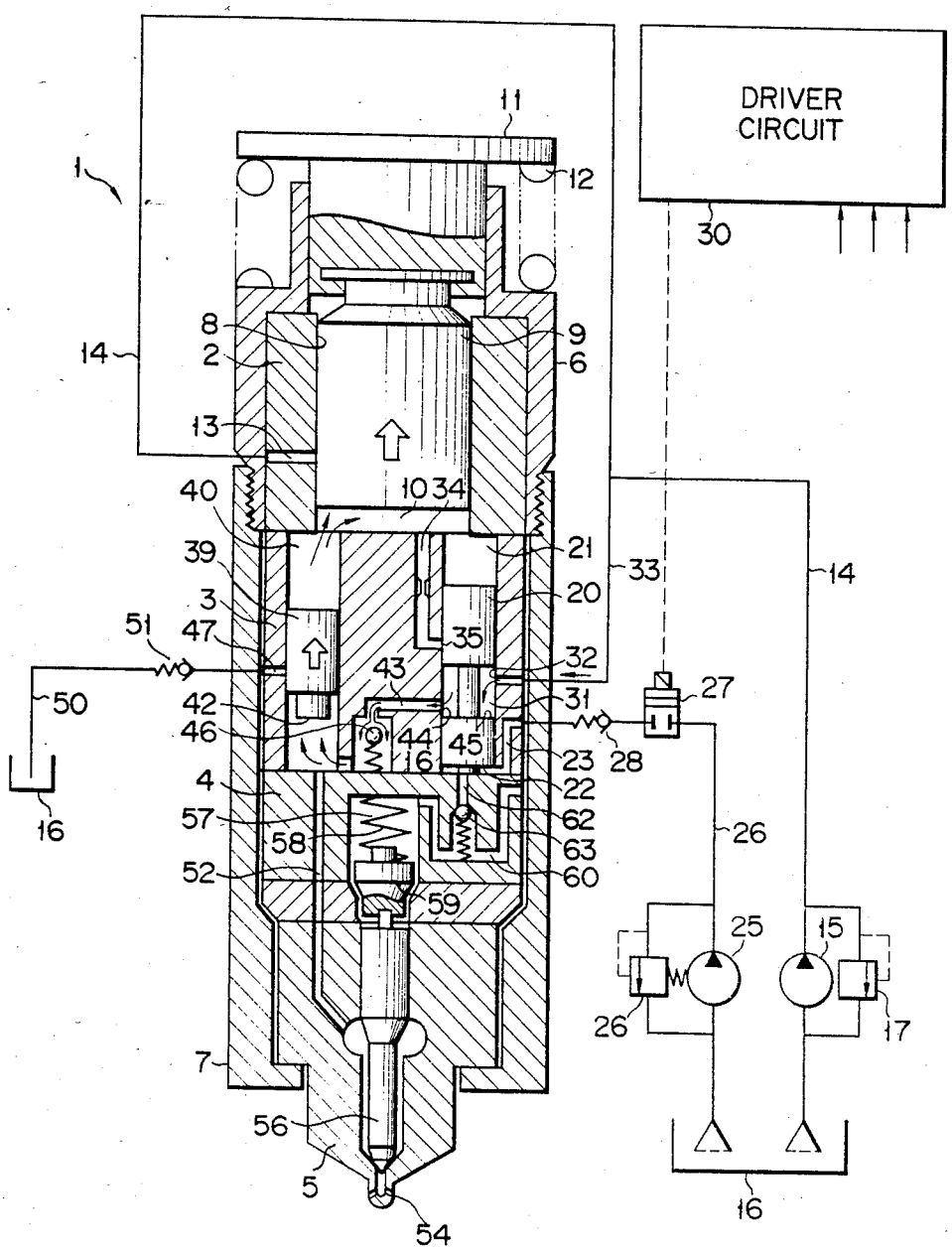
FIGS. 2 to 7 are sectional views sequentially explaining the operation of the unit injector shown in FIG. 1.

FIG. 2 shows the state wherein the plungers 9, 20 and 39 of the injector 1 are positioned at the respective bottom dead centers, and the plunger 9 is moved upward from this state by a biasing force of the spring 12, as indicated by an arrow in FIG. 2. When the plunger 9 is moved upward from the bottom dead center, the pressure in the chamber 10 and the chamber 40, communicating with the chamber 10, is reduced. Thus, fuel can be supplied from the pump 15 to the chamber 42 through the paths 14 and 33, the hole 32, the groove 31, the hole 43 and the valve 46, thereby moving the plunger 39 upward, as indicated by an arrow in FIG. 2. On the other hand, the pressure in the other chamber 21 communicating with the chamber 10 is also reduced. However, in this case, the fuel flow into the chamber 22 is prevented by the solenoid operated valve 27 and the check valve 63, as shown in FIG. 2. Thus, the plunger 20 cannot be moved upward from the bottom dead center.

Figure 3:
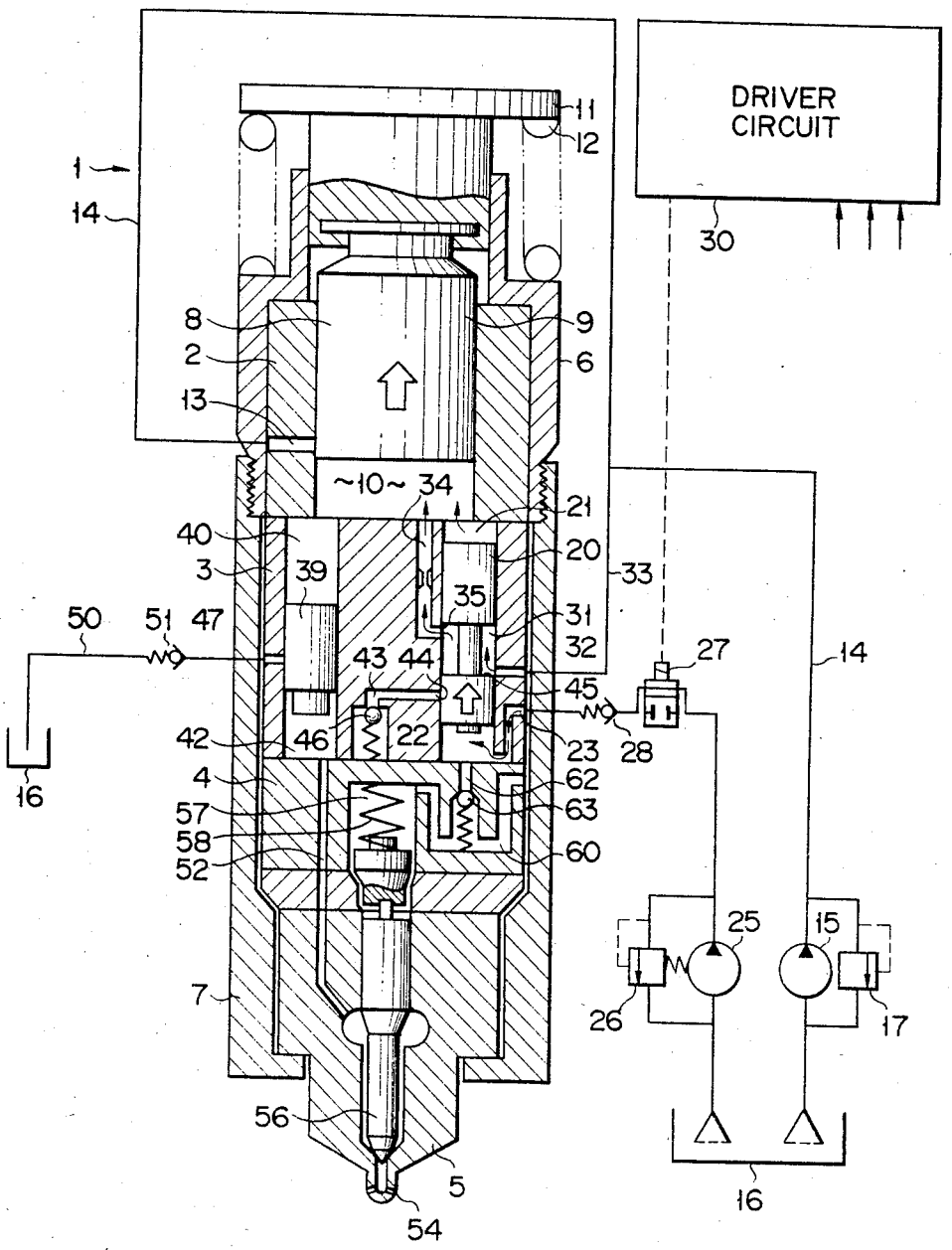

As described above, in the process of moving the plunger 39 upward by introducing fuel into the chamber 42, a control signal is supplied to the valve 27 from the driver circuit 30, the valve 27 being switched to an open position in response, as shown in FIG. 3. Then, fuel is supplied from the pump 25 to the chamber 22 through the valves 27 and 28 and the hole 23. In this case, since the fuel pressure supplied from the pump 25 is lower than the opening pressure of the valve 63, fuel supplied to the chamber 22 is not supplied to the tank 16 side through the valve. Furthermore, since the pressure supplied from the pump 25 to the chamber 22 is higher than the pressure of fuel supplied from the pump 15 and flowing through the groove 31, the plunger 20 can be moved upward from the bottom dead center by the fuel pressure in the chamber 22, as indicated by an arrow in FIG. 3. When the plunger 20 is moved upward from the bottom dead center, the surface 45 of the plunger 20 is moved upward so as to close the port 44 of the hole 43; that is, the hole 43 is closed by the plunger 20. Therefore, at this time, the fuel supply to the chamber 42 is stopped. In other words, the quantity of fuel supplied to the chamber 42, i.e., fuel injection quantity can be controlled by controlling the valve opening timing of the valve 27.

When the plunger 20 is moved upward from the bottom dead center and the hole 43 is closed as described above, the hole 34 is opened by the surface 36 of the plunger 20. Thus, fuel supplied from the pump 15 in the groove 31 is supplied from the groove 31 to the chamber 10 through the hole 34 upon further upward movement of the plunger 9.

Figure 4:
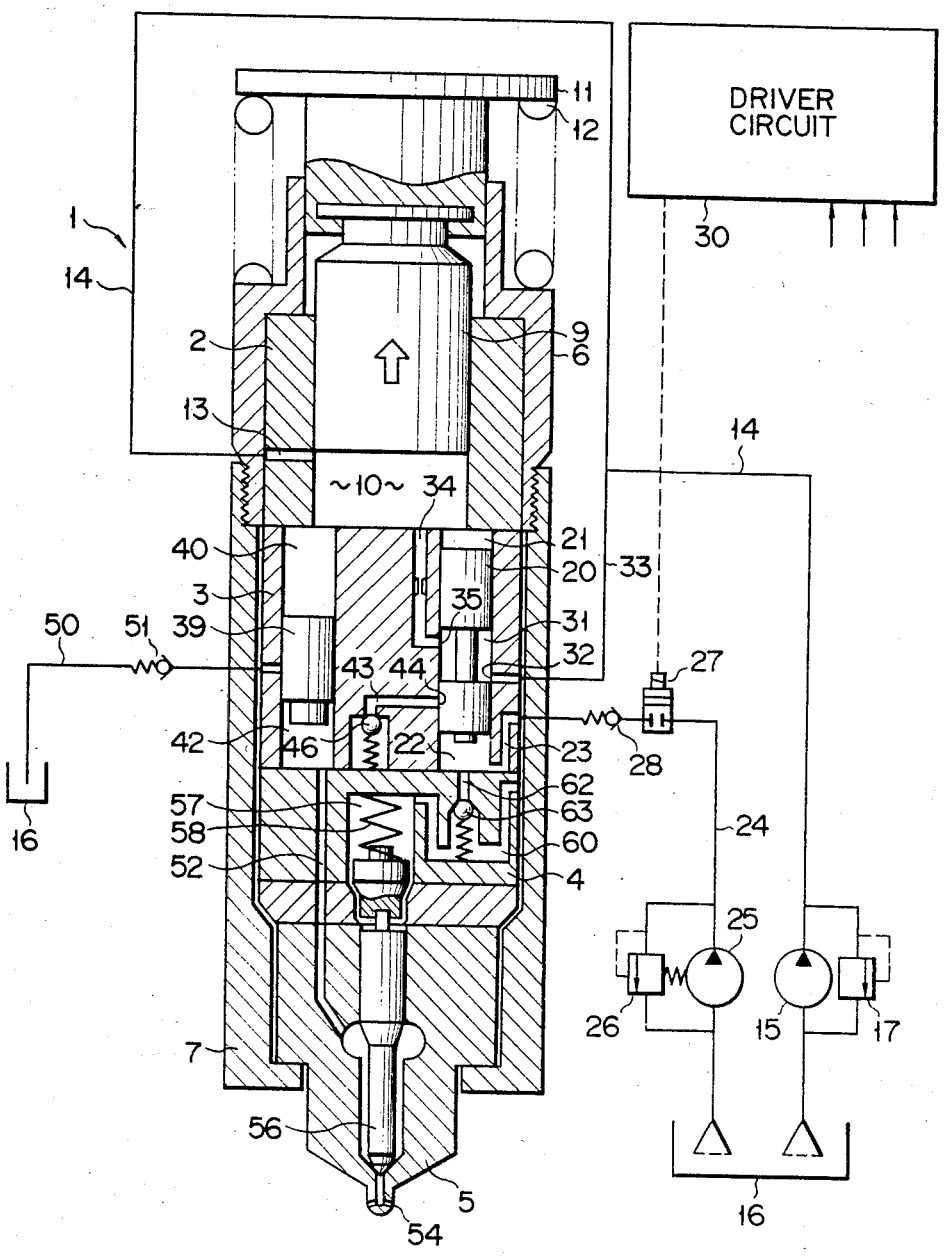

In the process of supplying fuel from the pump 25 to the chamber 22 so as to move the plunger 20 upward, when the solenoid operated valve 27 is closed in response to the control signal from the circuit 30, as shown in FIG. 4, fuel supply to the chamber 22 is stopped, with the plunger 20, lilcewise, being stopped at a position corresponding to the fuel quantity introduced into the chamber 22. In other words, the fuel quantity introduced into the chamber 22 can be controlled by controlling the valve closing timing of the valve 27.

In this manner, even after both the plungers 39 and 20 are stopped, the plunger 9 is continuously moved upward toward the top dead center. However, in this case, the fuel introduced from the pump 15 in the groove 31 is continuously supplied to the chamber 10 through the hole 34, as described above. When the plunger 9 is moved upward to a predetermined point, the hole 13 is opened by the lower surface of the plunger 9, as shown in FIG. 4, and fuel supplied from the pump 15 is supplied to the chamber 10 through the path 14 and the hole 13.

After the plunger 9 has reached the top dead center, the plunger 9 begins to pressurize the fuel in the chamber 10, when the plunger 9 is pressed downward by the above-mentioned cam. However, in this state, since the hole 13 is open, the fuel in the chamber 10 escapes to the tank 16 side through the hole 13 and the path 14 upon downward movement of the plunger 9, and the fuel in the chamber 10 is not pressurized.

Figure 5:
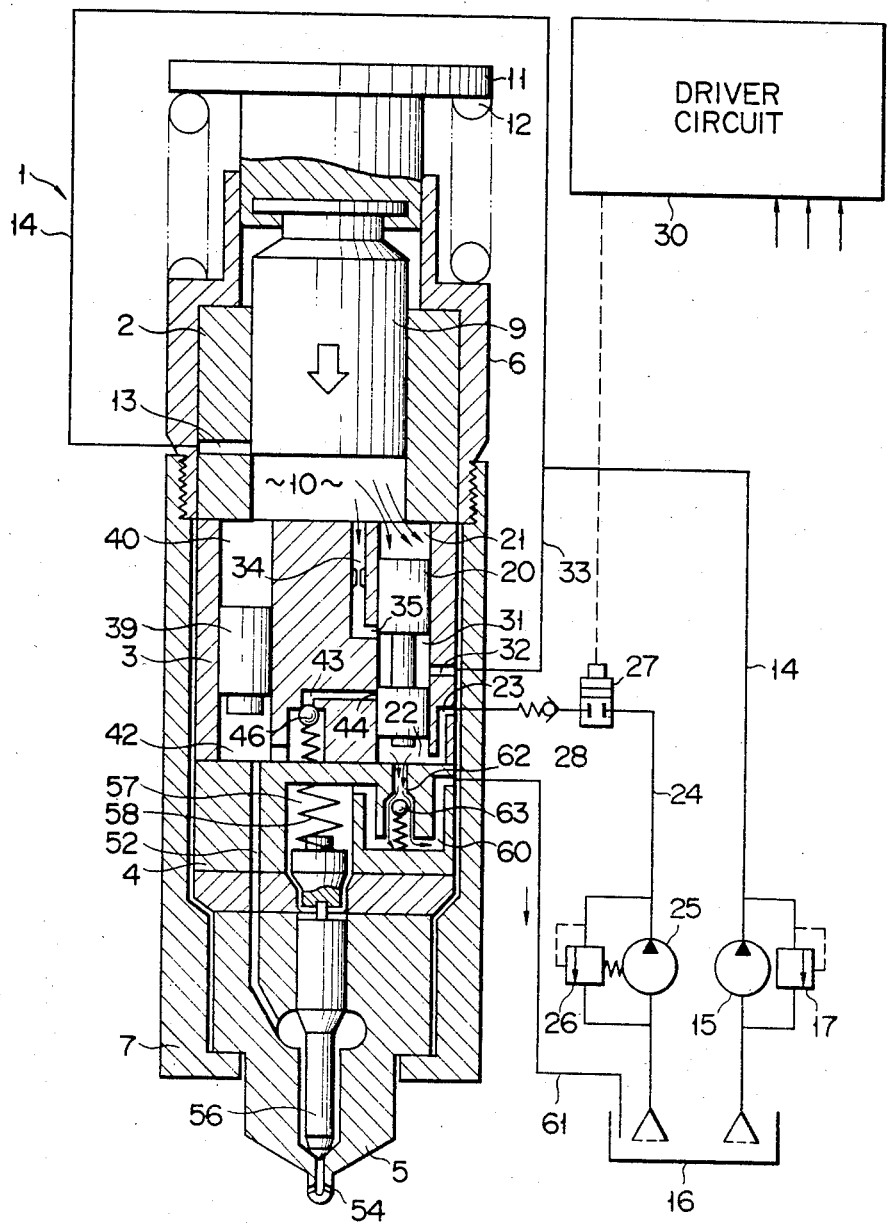

Furthermore, when the plunger 9 is moved downward and the hole 13 is closed thereby, as shown in FIG. 5, pressurization of fuel in the chamber 10 begins by the downward movement of the plunger 9. In this case, although the chamber 10 communicates with the pump 15 through the hole 34, groove 31 and the paths 33 and 14, since the portion 37 is provided in the hole 34, fuel in the chamber 10 can be pressurized. In this manner, the pressure of the fuel in the chamber 10 is applied to the upper end faces of the plungers 9 and 39, respectively, through the chambers 21 and 40. When the pressure applied to the upper end face of the plunger 9, i.e., the fuel pressure in the chamber 22, exceeds the valve opening pressure of the valve 63, the valve 63 is opened as shown in FIG. 5, thereby relieving the fuel in the chamber 22 to the tank 61 through the holes 62 and 60 and the path 61. Therefore, the plunger 20 is moved downward by the pressure in the chamber 10 upon the downward movement of the plunger 9. The downward movement speed of the plunger 20 is increased in accordance with the ratio of the diameters of the plungers 9 and 20 so as to be higher than that of the plunger 9. In this state, the pressure of fuel pressurized in the chamber 22 is transmitted toward the solenoid operated valve 27 through the hole 23 and the path 24. However, since the check valve 28 is provided in the path 24 between the valve 27 and the hole 23, the pressure of the chamber 22 is not applied to the solenoid operated valve 27.

On the other hand, the fuel pressure in the pump 10 is also applied to the upper surface of the plunger 39, i.e., the fuel in the chamber 42. However, since the valve opening pressure of the nozzle needle 56 is set so as to be greater than that of the check valve 63, the needle 56 is not lifted at this time. In other words, the plunger 39 is not moved downward by the pressure in the chamber 10 at this time.

Figure 6:
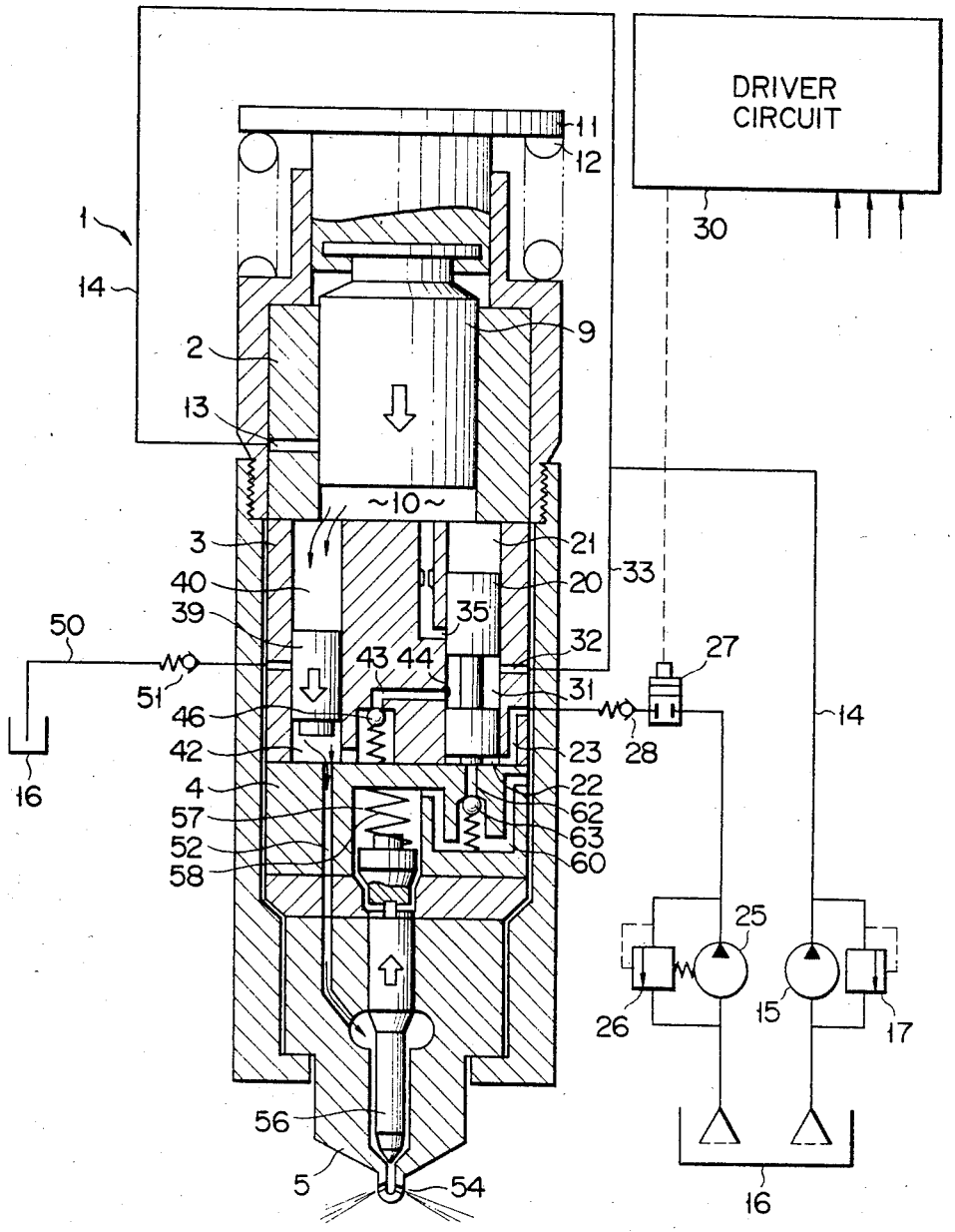

When the plunger 20 reaches the bottom dead center, as shown in FIG. 6, fuel is no longer relieved from the chamber 22 and, in addition, the hole 34 is kept closed by the plunger 20. For this reason, the fuel pressure in the chamber 10 is immediately increased upon the downward movement of the plunger 9, and is applied to the upper surface of the plunger 39. Thus, at this time, the plunger 39 begins to move downward, as indicated by an arrow in FIG. 6, thereby pressurizing the fuel in the chamber 42. That is, after the plunger 20 reaches the bottom dead center, the plunger 39 begins to move downward, i.e., pressurization of the fuel in the chamber 42 begins. In other words, after the plunger 20 reaches the bottom dead center, the fuel injection stroke is started.

In this manner, after the fuel injection stroke is started, the downward speed of the plunger 39 is accelerated as compared with the downward speed of the plunger 9, and in accordance with the ratio of the diameters of the plungers 9 and 20. When the fuel pressure in the chamber 42, increased upon the downward movement of the plunger 39, reaches the valve opening pressure of the nozzle needle 56, the needle 56 is lifted by the pressure in the chamber 42, i.e., the reservoir 53, thereby opening the valve hole 55, i.e., the holes 54. As a result, high pressure fuel is injected into the combustion chamber of the engine. This fuel injection step is continued until the plunger 39 is moved down to its bottom dead center. Therefore, the quantity of fuel injected from the hole 54, i.e., the fuel injection quantity corresponds to the fuel quantity introduced into the chamber 42.

Figure 7:
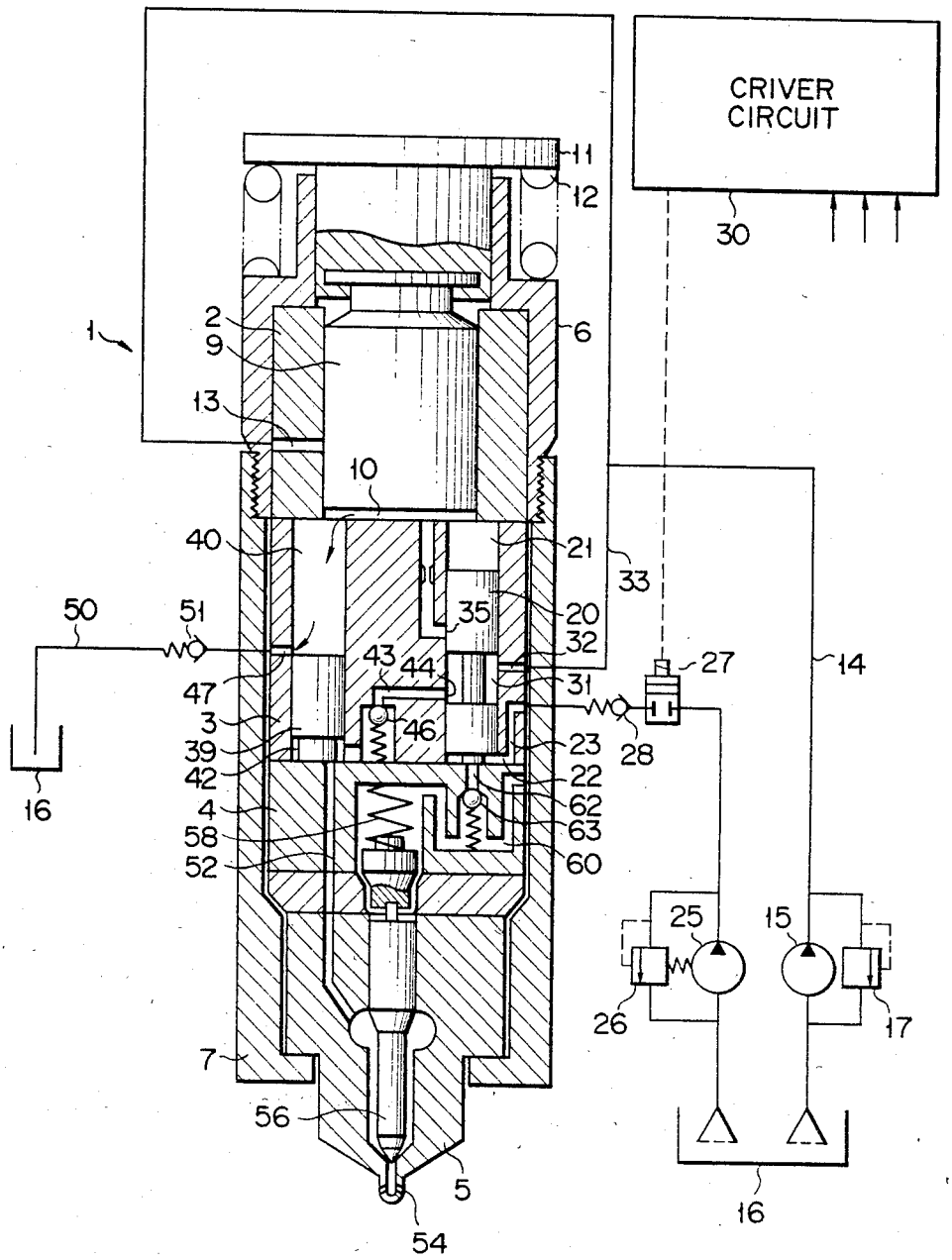

The plunger 9 is continuously moved downward even after the fuel injection step ends. However, when the plunger 39 reaches the bottom dead center, since the hole 47 is opened by the upper end face of the plunger 39, as shown in FIG. 7, fuel in the chambers 10 and 40 is discharged through the hole 47, the check valve 51 and the path 50 upon the downward movement of the plunger 9.

Thereafter, the plunger 9 reaches the bottom dead center, and the above-mentioned operation is repeated.

Figure 8:
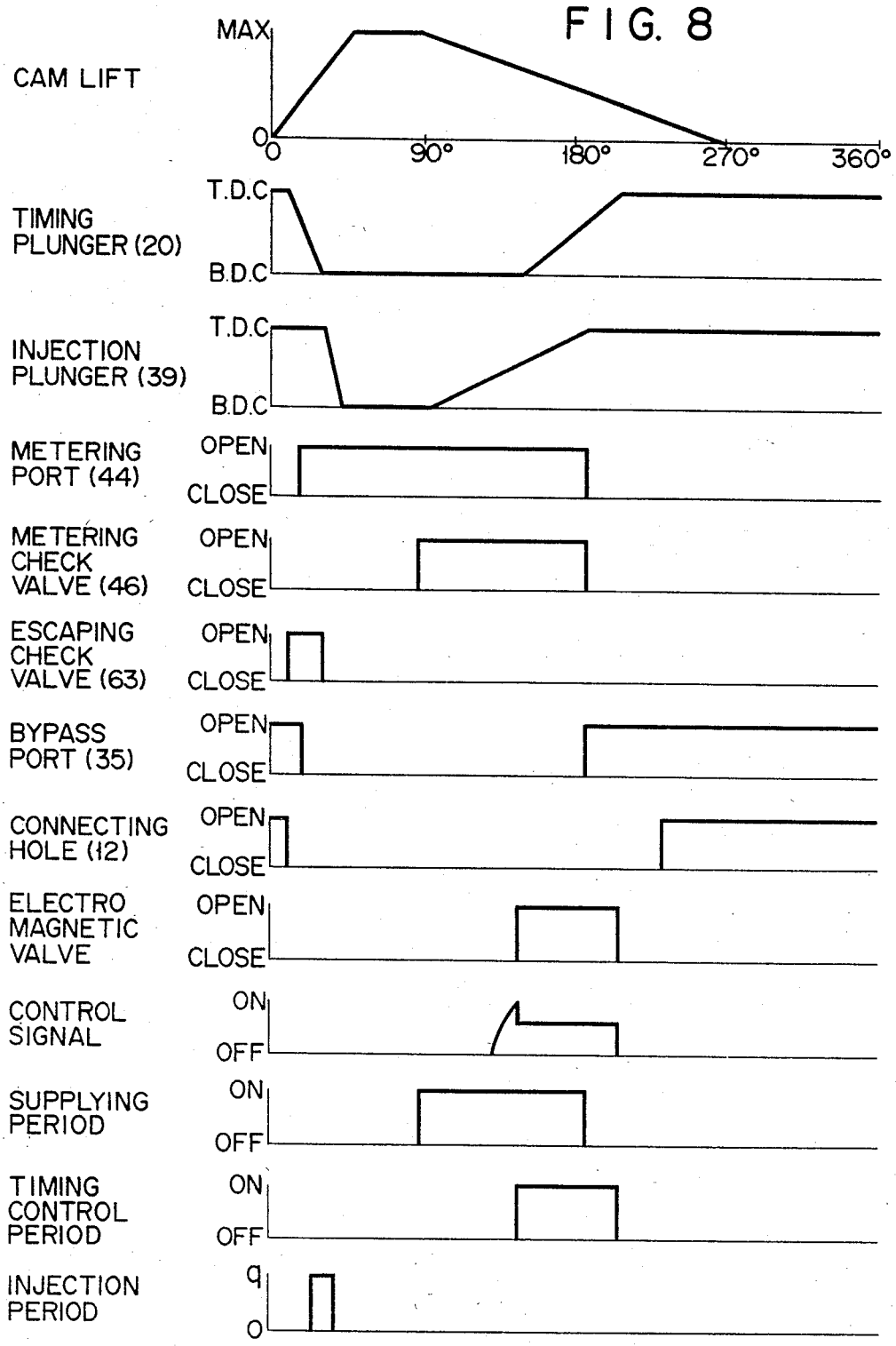
FIG. 8 is a timing chart showing the operation of the unit injector shown in FIG. 1.

FIG. 8 is a timing chart showing the operation of the fuel injection apparatus according to the first embodiment. By referring to FIG. 8, the above-mentioned operation of the fuel injection apparatus will be more clearly understood.

According to the fuel injection apparatus of the first embodiment, the quantity of fuel introduced in the chamber 42, i.e., the fuel injection quantity can be controlled by controlling the opening timing of the solenoid operated valve 27. When the closing timing of the valve 27 is controlled, the quantity of fuel introduced in the chamber 22, i.e., the start timing of the injection stroke can be controlled.

According to the first embodiment of the present invention, since the check valve 28 is inserted into the path 24 between the chamber 22 and the solenoid operated valve 27, even if the fuel in the chamber 22 is pressurized, the pressure in the chamber 22 is not transmitted to the valve 27, and the solenoid operated valve 27 can be reliably protected from damage. As a result, the normal operation of the fuel injection apparatus can be maintained for a long period of time.

Furthermore, since the diameter of the plunger 39 is smaller than that of the plunger 9, fuel in the chamber 42 is pressurized to a greater extent than in the chamber 10, and can be injected from the hole 54, thereby allowing the desired high pressure fuel injection.

The present invention is not limited to the fuel injection apparatus of the first embodiment, and modifications of the present invention will be described hereinafter. For the sake of simplicity, the same reference numerals in the following modifications denote the same parts as in the first embodiment.

Figure 9:
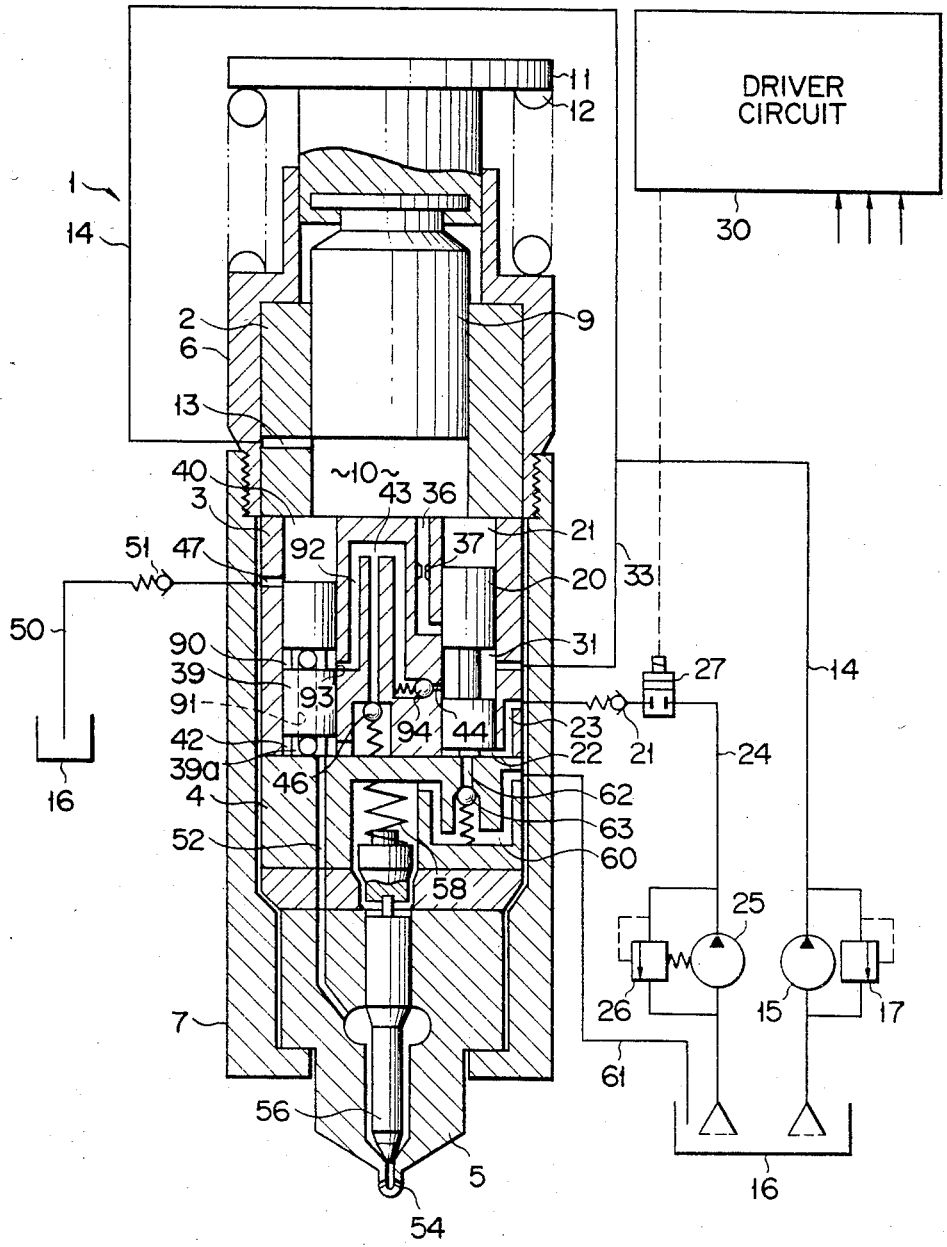
FIG. 9 is a sectional view showing a unit injector of a fuel injection apparatus according to a second embodiment of the present invention.

FIG. 9 shows a fuel injection apparatus according to a second embodiment of the present invention. In the apparatus according to the second embodiment, an annular groove 90 is formed at a central portion of an injection plunger 39. A communicating hole 91 having one end communicating with the groove 90 and the other end communicating with an injection pump chamber 42 is formed in the plunger 39. On the other hand, in an injection cylinder body 3, a spill hole 92 is formed to have one end open to an inner peripheral surface of an injection cylinder bore 38 and the other end communicating with an adjusting hole 43. A port 93 of the hole 92 is located so as to communicate with the groove 90 only when the plunger 39 is at its bottom dead center. The total volume of the holes 43 and 92 of this embodiment is set sufficiently larger than that of only the hole 43 in the first embodiment, and a check valve 94 is inserted into the hole 43 adjacent to an adjusting port 44.

According to the fuel injection apparatus of the second embodiment when, as is apparent from FIG. 9, the plunger 39 reaches the bottom dead center, the chamber 42 communicates with the holes 92 and 43 through the hole 91 and the groove 90, thereby immediately reducing the pressure in the chamber 42. As a result, fuel injection can be stopped immediately when completed.

Figure 10:
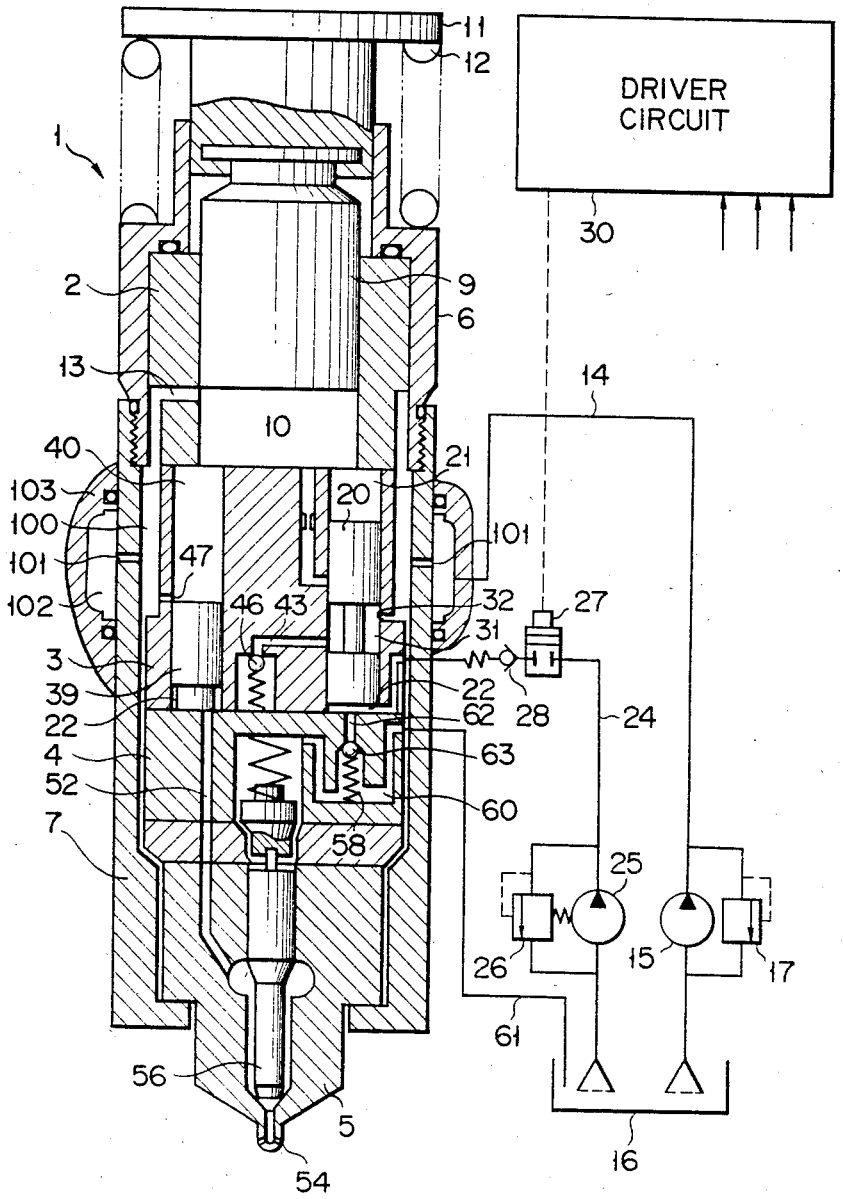
FIG. 10 is a sectional view showing a unit injector of a fuel injection apparatus according to a third embodiment of the present invention.

FIG. 10 shows a fuel injection apparatus according to a third embodiment of the present invention. In the apparatus of the third embodiment, a fuel gallery 100 is defined between a retaining nut 7 and an injection cylinder body 3. The gallery 100 is coupled to a connecting hole 13, a communicating hole 32, and a spill hole 47, respectively. The gallery 100 is connected to a head gallery 102 through a plurality of holes 101 formed in the nut 7. The gallery 102 is defined so as to surround the nut 7 in a cylinder head 103 of an engine on which a unit injector 1 is mounted, and is connected to a supply path 14. The gallery 102 is liquid-tight, being held by a pair of O-rings 104. According to the apparatus of the third embodiment, the unit injector 1 can be easily connected to a low-pressure side fuel supply pump 15 and a fuel tank 16.

Figure 11:
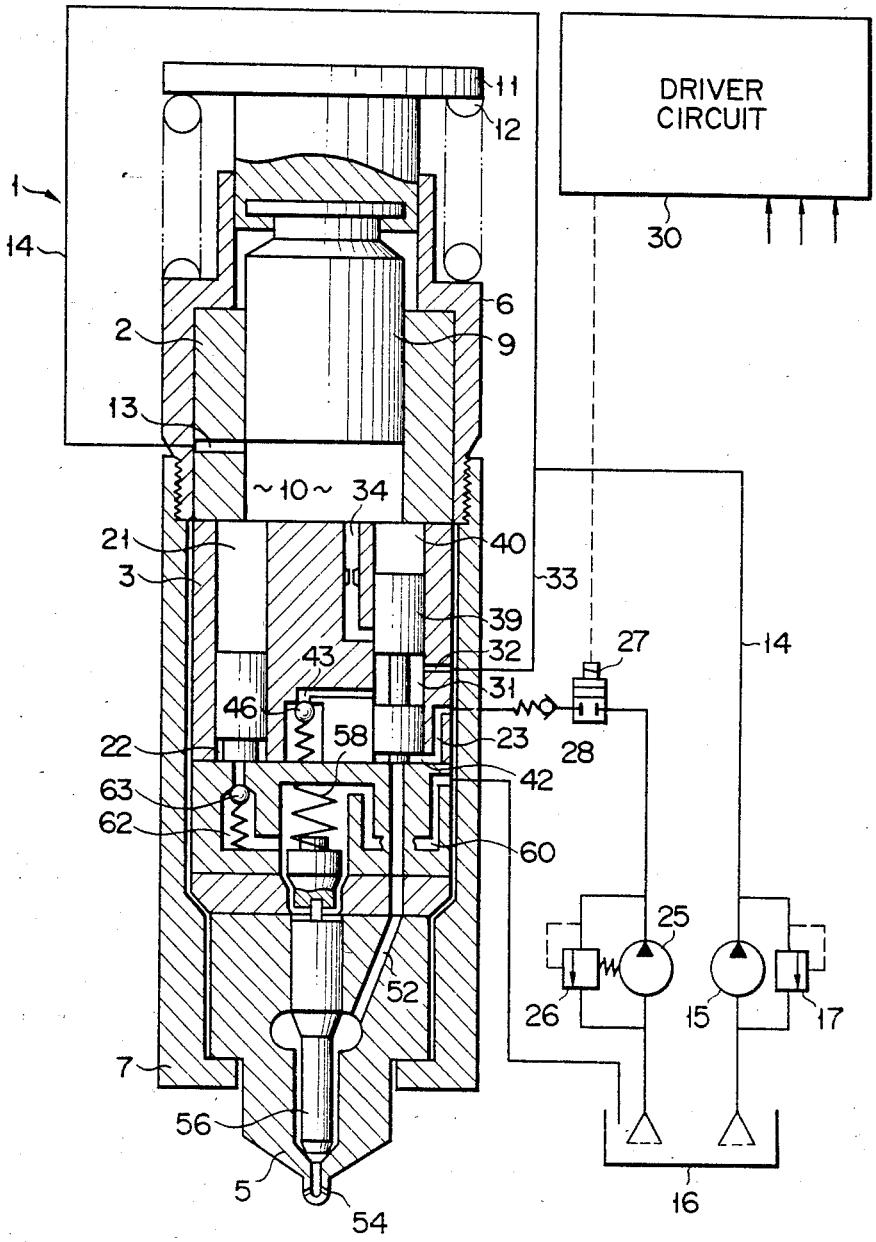
FIG. 11 is a sectional view showing a unit injector of a fuel injection apparatus according to a fourth embodiment of the present invention.

FIG. 11 shows a fuel injection apparatus according to a fourth embodiment of the present invention. Differences between the first and fourth embodiments are that the timing plunger 20 in the first embodiment is used as an injection plunger 39, the injection plunger 39 in the first embodiment is used as a timing plunger 20, and the relief hole 47 in the first embodiment is omitted. Unlike the first embodiment, the quantity of fuel introduced into a timing chamber 22, i.e., the fuel injection quantity can be controlled by controlling the opening timing of a solenoid operated valve 27, and the quantity of fuel introduced into an injection pump chamber 42, i.e., a fuel injection quantity can be controlled by controlling the closing timing of the valve 27.

Figure 12:
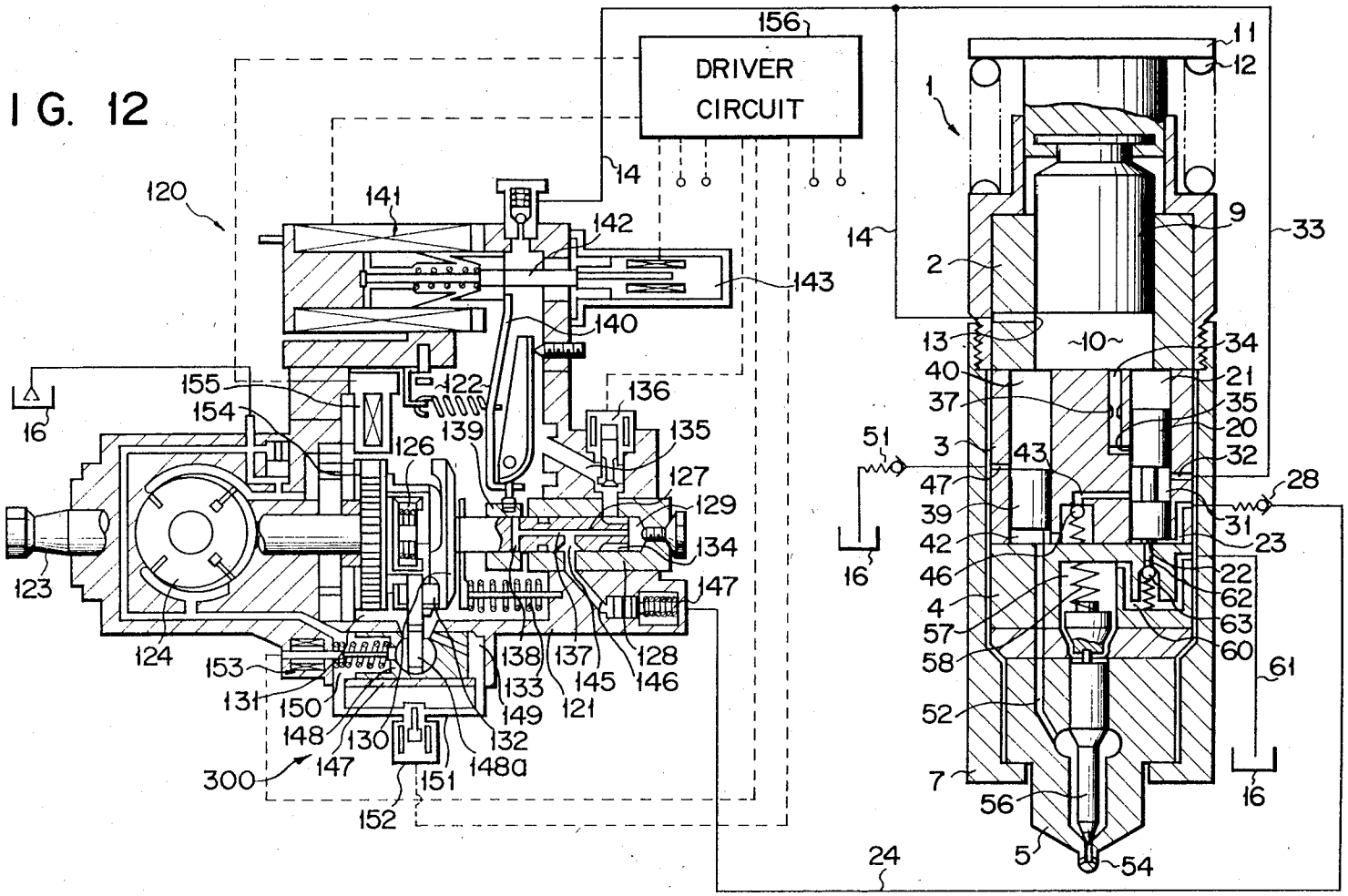
FIG. 12 is a sectional view showing a unit injector of a fuel injection apparatus according to a fifth embodiment of the present invention.

FIG. 12 shows a fuel injection apparatus according to a fifth embodiment of the present invention. The apparatus of the fifth embodiment comprises the unit injector 1 shown in FIG. 1, a distributor type fuel injection pump 120 as the low-pressure side fuel supply pump 15 and the high-pressure side fuel supply pump 25 of FIG. 1. Since the pump 120 is well known to those skilled in the art, it will be briefly described. The pump 120 comprises a pump housing 121 in which a fuel supply chamber 122 is defined. A drive shaft 123 extending into the chamber 122 is rotatably supported by the housing 121. In the case of a 4-cylinder, 4-cycle engine, the shaft 123 is rotated once every two rotations of a crankshaft of the engine. A feed pump or a vane pump 124 is mounted on the shaft 123. The pump 124 is driven upon rotation of the shaft 123, and draws fuel from a fuel tank 16 so as to supply it to the chamber 122. The chamber 122 is connected to a connecting hole 13 of the unit injector 1 through a check valve 125 and a supply path 14, and is also connected to a communicating hole 32 of the injector 1 through a branch path 33 branched from the path 14. That is, the pump 124 serves as the low-pressure side fuel supply pump 15 in the first embodiment.

An end portion of the shaft 123 positioned in the chamber 122 is coupled to a distribution plunger 127 through a shaft coupling 126. The coupling 126 transmits rotations of the shaft 123 to the plunger 127 so as to rotate the plunger 127 in synchronism with the shaft 123, but allows the plunger 127 to move along the axial direction of the shaft 123.

The other end portion of the plunger 127, distant from the coupling 126, is inserted in a distribution cylinder 128 mounted on the housing 121. A distribution pump chamber 129 is defined in the cylinder 128 by an end face of the plunger 127.

A face cam 130 is provided on an edge portion of the plunger 127 at the side of the coupling 126. The cam 130 is brought into contact with the plurality of rollers 132 of a roller ring 131 by the biasing force of a spring 133. The roller ring 131 is rotatably supported on an inner wall of the housing 122. When the cam 130 and the rollers 132 of the roller ring 131 are interlocked with each other, the plunger 127 can be reciprocated along its axial direction the same number of times as the number of cylinders of the engine during one rotation.

As many intake grooves 134 as the number of engine cylinders are formed in an outer peripheral surface of a head portion of the plunger 127 at equal intervals in the circumferential direction. These grooves 134 communicate with the chamber 129. The grooves 134 can be sequentially connected to one end of an intake hole 135 formed in the housing 121 and cylinder 128 upon rotation of the plunger 127. The other end of the hole 135 always communicates with the chamber 122. Furthermore, a solenoid fuel cut valve 136 for opening/closing the hole 135 is provided in the housing 121.

A communicating hole 137 extending along the axial direction is formed in the plunger 127. One end of the hole 137 communicates with the chamber 129, and the other end thereof communicates with a plurality of radial holes 138 formed in the plunger 127. These holes 138 are open to the outer peripheral surface of the plunger 127 exposed in the chamber 122. In the state shown in FIG. 12, openings of the holes 138 are closed by a seal ring 139 mounted on the outer peripheral surface of the plunger 128 so as to slide freely.

One end of the control lever 140 is coupled to the ring 139. The lever 140 is axially supported at its central portion so as to be rotatable, and the other end of the lever 140 is coupled to a rod 142 of a linear solenoid 141 as an actuator. That is, when the solenoid 141 is actuated, the lever 140 is rotated through the rod 142, thereby moving the ring 139 along the axial direction of the plunger 127. A position sensor 143 for the ring 139 is provided on the housing 121 for detecting the position of the ring 139 along the axial direction in accordance with a degree of actuation of the rod 142.

A distribution hole 145 is connected midway along the hole 137 of the plunger 127, and is open to the outer peripheral surface of the plunger 127. The opening of the hole 145 can be connected, upon rotation of the plunger, to a plurality of delivery holes 146 formed in the cylinder 128 and the housing 121. These holes 146 are provided so as to be as many in number as the engine cylinders, the openings of the holes 146 open to the inner peripheral surface of the cylinder 128 being arranged at equal intervals in the circumferential direction. The holes 146 are connected to a pressure supply path 24 through a delivery valve 147. The path 24 is connected to an introduction hole 23 through a timing check valve 28, as shown in FIG. 12.

The above-mentioned roller ring 131 is rotated by a liquid pressure timer 300. The timer 300 comprises a timer cylinder 147 mounted on the outer surface of the housing 121. A timer piston 148 is fitted in the cylinder 147, and is coupled to the roller ring 131 through a coupling rod 148*a*, as shown in FIG. 12. Note that although the axial direction of the piston 148 is perpendicular to the axial direction of the plunger 127, the timer piston 148 is shown parallel to the plunger 127 in FIG. 12 for the sake of simplicity. In the cylinder 147, first and second chambers 149 and 150 are defined by two ends of the piston 148. The first chamber 149 is connected to the chamber 122 through a path formed in the piston 148. Therefore, fuel in the chamber 122 is introduced into the first chamber 149, thereby applying the fuel pressure to one end of the piston 148. The chamber 149 is connected to the second chamber 150 through a path 151 in which a timing control valve 152 comprising a solenoid operated valve is inserted. The chamber 150 is connected at the intake side of the pump 124. Furthermore, a spring 153 is housed in the chamber 150, and biases the piston 148 to the side of the chamber 149 by a predetermined force.

A position sensor 153 is provided on the cylinder 147 so as to detect the position of the piston 148 along the axial direction, the sensor 153 being similar to the sensor 143.

Furthermore, a gear 154 is mounted on the shaft 123 to be positioned between the pump 124 and the coupling 126. An electromagnetic pickup sensor 155 is arranged on the housing 121 so as to be adjacent to and opposite the toothed surface of the gear 154. The sensor 155 supplies a pulse signal to a driver circuit 156 every time a tooth of the gear 154 passes therebelow. The circuit 156 measures the speed of the gear 154, i.e., the shaft 123 in accordance with the pulse signal from the sensor 155. In addition to the signal from the sensor 155, the circuit 156 receives signals from, respectively, a position sensor for detecting the position of the accelerator pedal of the vehicle, a pressure sensor for detecting the air intake pressure in the engine, a temperature sensor for detecting the intake air temperature and another temperature sensor for detecting the temperature of the engine's cooling water. In accordance with these signals, the circuit 156 generates control signals for controlling the operation of the valve 136, the solenoid 141 and the valve 152.

The operation of the distributor type fuel injection pump will be described hereinafter. In the process of moving the plunger 127 along the direction of the shaft 123, when one of the intake grooves of the plunger 127 communicates with the intake hole 135 at a certain rotational angle position, fuel in the chamber 122 is introduced into the chamber 129 through the hole 135 and the groove 134. Thereafter, when the plunger 127 is rotated at a certain rotational angle and the hole 135 is disconnected from the groove 134, the plunger 127 is moved to the side of the chamber 129. Thus, fuel in the chamber 129 is pressurized by the plunger 127. In this process, when the plunger 127 is further rotated by a certain rotational angle, the hole 145 is connected to one of the holes 146. Then, the pressurized fuel is supplied to the path 24, i.e., the hole 32 of the injector 1 through the holes 137 and 146 and the valve 147. In such a process of supplying the pressurized fuel, when the plunger 127 is moved to the side of the chamber 129 and the opening of the hole 138 is exposed from the ring 139, the pressurized fuel in the chamber 129 is returned to the chamber 122 through the holes 137 and 138. That is, when the hole 138 is connected to the chamber 122, supply of the pressurized fuel from the pump 120 to the injector 1 is stopped. Since the connecting timing of the hole 138 and the chamber 122 can be controlled by controlling the position of the ring 139 along the axial direction by the solenoid 141 and the lever 140, the fuel supply from the pump 120 to the injector 1 can be controlled.

The fuel supply timing from the pump 120 to the injector 1 can be controlled in the following manner. Since the chamber 149 of the timer 146 is connected to the chamber 122, fuel having the same pressure as in the chamber 122 is introduced into the chamber 149. Furthermore, since the fuel pressure in the chamber 122 is varied in accordance with the pump 124, i.e., the engine speed, the fuel pressure in the chamber 149 is also varied in accordance with the engine speed. Therefore, when the operation of the valve 152 is controlled, the fuel pressure in the chamber 149 is adjusted, with the piston 148 being moved by the adjusted pressure so as to be set at a predetermined position along the axial direction. In this manner, the roller ring 131 can be rotated by moving the piston 148 through the rod 148*a* at a predetermined rotational angle. As a result, the contact position of the roller 132 in the ring 126 and with respect to the cam 130 is shifted in the circumferential direction. This means that the reciprocal movement timing of the plunger 127 with respect to a rotating phase angle of the shaft 123, i.e., the supply timing of the pressurized fuel from the pump 120 to the injector 1 is changed. Note that in the above embodiment, only the fuel supply from the pump 120 to the single injector 1 has been described. However, the pressurized fuel is supplied to other unit injectors provided for each cylinder of the engine in the same manner as described above.

When the above-mentioned pump 120 is used, fuel in the chamber 122 can be supplied to the hole 32 of the injector 1 through the paths 14 and 44 in the same manner as in the low-pressure side fuel supply pump 15 of the first embodiment. In addition, fuel pressurized in the chamber 129 and at a pressure higher than that in the chamber 122 can be supplied to the hole 23 of the injector 1 through the path 24 in the same manner as in the high-pressure side fuel supply pump 25 of the first embodiment. Furthermore, the introduction timing of fuel introduced from the pump 120 to the chamber 22 of the injector 1 through the hole 23 can be controlled by adjusting the supply timing of the pressurized fuel supplied from the pump 120 through the path 24 by using the timer 146. Therefore, the quantity of fuel injected from the injector 1 can be controlled in the same manner as in the first embodiment. The quantity of fuel introduced into the chamber 22 can be controlled by varying the position of the ring 139 along the axial direction by the solenoid 141 and the lever 140. Thus, the fuel injection timing can be controlled in the same manner as in the first embodiment.

Figure 13:
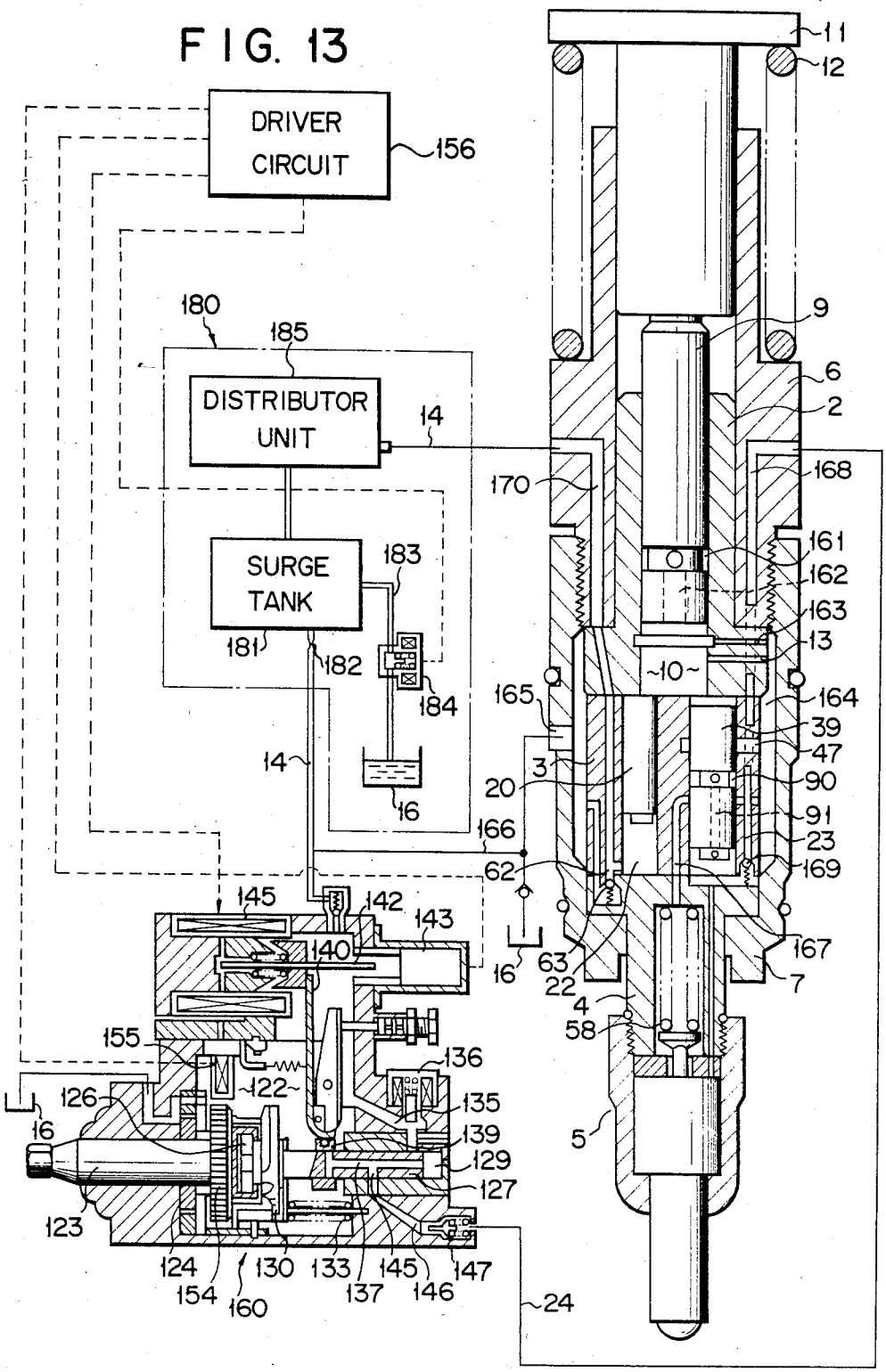
FIG. 13 is a sectional view showing a unit injector of a fuel injection apparatus according to a sixth embodiment of the present invention.

FIG. 13 shows a fuel injection apparatus according to a sixth embodiment of the present invention. The apparatus of the sixth embodiment comprises a unit injector 1' and a distributor type fuel injection pump 160. The injector 1' has the same function as the unit injector 1 in the first embodiment, but has a different structure, as can be seen from FIG. 13. Only an understanding of the structural difference between the unit injectors 1 and 1' in the first and sixth embodiments is required to understand the present invention. This difference will be described hereinafter. First, an annular groove 161 is formed in a pressure supply plunger 9 of the unit injector 1'. The groove 161 is connected to a pressure supply chamber 10 through a connecting hole 162. Also, the groove 161 can be connected to a connecting hole 163 formed in a pressure supply cylinder body 2 only when the plunger 9 is at its bottom dead center. The hole 163 and the above-mentioned connecting hole 13 are connected to a fuel gallery 164 formed between the body 2, an injection cylinder body 3 and a retaining nut 7. The gallery 164 is connected to a supply path 14 through a hole 165 and a path 166 formed in the nut 7.

The injection plunger 39 and the timing plunger 20 are provided in the injector 1' in the same manner as in the third embodiment shown in FIG. 11. In the sixth embodiment, an annular groove 90 and a communicating hole 91 having the same function as in the second embodiment are formed in the plunger 39, and a spill hole 92, interlocked with the groove 90, is connected to the gallery 164. Furthermore, in the sixth embodiment, when the plunger 39 reaches the bottom dead center, a spring chamber 57 is connected to the groove 90 through a path 167.

As is apparent from FIG. 13, in the case of the injector 1' of the sixth embodiment, the adjusting hole 43, the communicating hole 32 and the adjusting check valve 46 provided in the injector 1 are omitted. That is, a quantity of fuel adjusted by the pump 160 is introduced into the chamber 40 through the path 24 and an introduction hole 168 formed in the bodies 2 and 3. Thus, in the sixth embodiment, a check valve 169 is inserted midway along the hole 168 in place of the valve 46.

The timing chamber 22 is connected to the path 14 through a supply hole 170 formed in the bodies 2 and 3. Therefore, fuel in the chamber 122 of the pump 160 is supplied to the chamber 22. The hole 170 is connected to a spill hole 62, and the hole 62 is connected to the gallery 164. A spill check valve 63 is inserted in the hole 62.

The pump 160 of the sixth embodiment has the same structure as that of the pump 120 described in the fifth embodiment, except that the pump 160 is not provided with the liquid pressure timer 300. Therefore, even though the chambers 122 and 22 are simply connected to each other through the path 14 and the hole 170, the adjusted quantity of fuel cannot be supplied to the chamber 22. In other words, the fuel injection timing cannot be controlled.

For this reason, in the sixth embodiment, a distribution device 180 for adjusting the fuel supply to the chamber 22 is provided midway along the path 14. The structure of the device 180 will be described hereinafter. The device 180 comprises a surge tank 181 arranged at an upstream side of the path 14. A stricture 182 is provided in the path 14 adjacent to the tank 181. The tank 181 is connected to a fuel tank 16 through a return path 183. A solenoid operated valve 184 is inserted in the path 183. Therefore, the fuel pressure supplied from the chamber 122 to the tank 181 through the path 14 can be arbitrarily set by opening/closing the valve 184. The opening/closing operation of the valve 184 is controlled by a control signal supplied from a driver circuit 156 in accordance with the operating condition of the engine.

Figure 14:
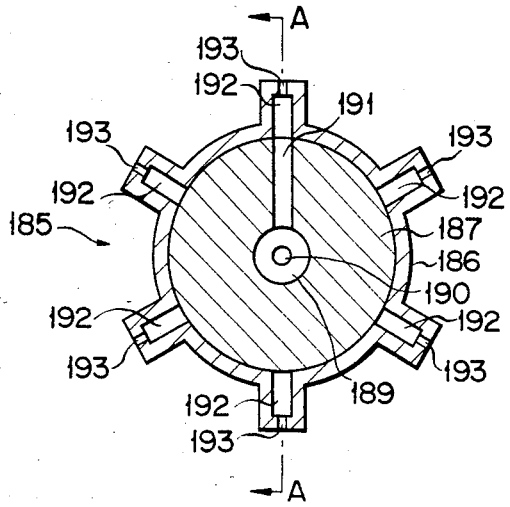
FIG. 14 is a sectional view showing a distribution unit of the fuel injection apparatus shown in FIG. 13.
Figure 15:
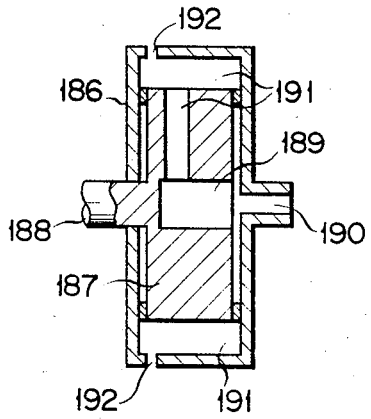
FIG. 15 is a sectional view taken along a line A—A in FIG. 14.

A distributor unit 185 is provided along the path 14 at a downstream side of the tank 181. FIGS. 14 and 15 show the unit 185 in more detail. The unit 185 comprises a hollow cylindrical unit housing 186. A rotor 187 is rotatably fitted in the housing 186. The rotor 187 is formed integrally with a rotating shaft 188 which is rotated at half the engine speed. A bore 189 is defined at a central portion of the rotor 187, and is connected to a connecting port 190 formed in the housing 186. The port 190 is connected to the tank 181 through the path 14. A radial hole 191 having one end connected to the bore 189 and the other end open to the outer peripheral surface of the rotor 187 is formed in the rotor 187. The hole 191 can be sequentially connected to outlet chambers 192 of the housing 186 upon the rotation of the rotor 187. The chambers 192 are arranged on the outer peripheral surface of the housing 186 at equal intervals in the circumferential direction. The chambers 192 are connected to the injector 1' through a port 193 via the path 14 at the side of the injector 1'. As is apparent from FIG. 14, since the unit 185 comprises six chambers 192, the unit 185 of the sixth embodiment is applied to a 6-cylinder engine. Therefore, unlike the pump 120 of the fifth embodiment, the pump 160 of the sixth embodiment is applied to a 6-cylinder engine.

In the device 180, fuel in the tank 181 is supplied to the chamber 22 of the injector 1' connected to the chambers 192 through the path 14 and the hole 170 every time the hole 191 of the rotor 187 communicates with the corresponding chamber 192 upon rotation of the rotor 187. Thus, the quantity of fuel q supplied to the chamber 22 is given by the following relation:

$$q = \alpha \cdot A \sqrt{2g \cdot \Delta p/r} \cdot T$$

where $\alpha$ is a constant; A, a cross-sectional area of the path between the tank 181 and the chamber 22; g, a gravitational acceleration; $\Delta p$, the difference between pressures in the tank 181 and the chamber 22; r, the specific weight of fuel; and T, the length of time the hole 191 is connected to the chamber 192.

Figure 16:
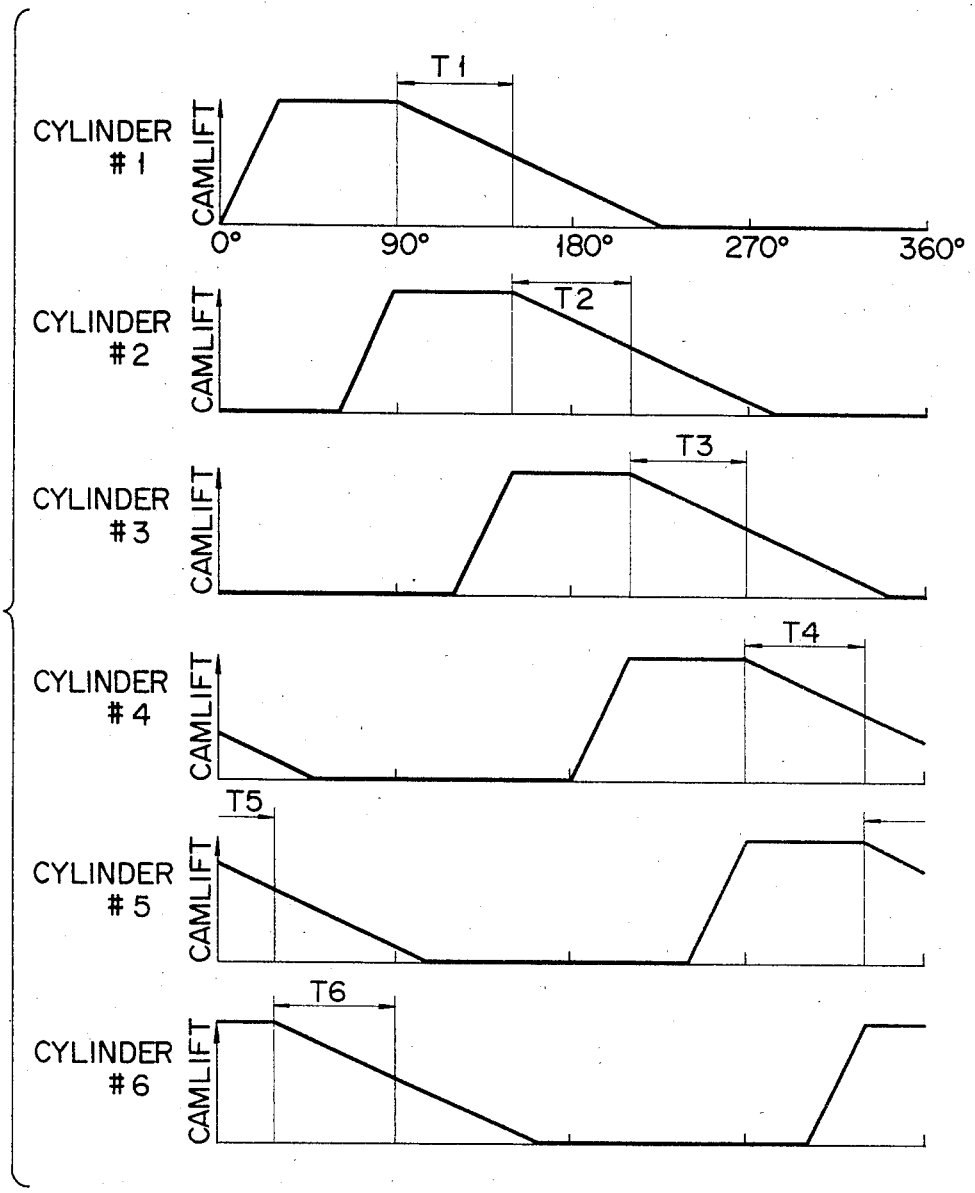
FIG. 16 is a timing chart showing the operation of the distribution unit of FIG. 15.

In the above relation, $\alpha$, A, g, and r are constants, and the connection interval T is determined by the rotating speed of the rotor 187, i.e., the engine speed. Therefore, when the difference $\Delta p$ is varied, the fuel quantity q supplied to the chamber 22 can be controlled. The connection intervals T1 to T6 between the tank 181 and the chambers 22 of the first to sixth injectors 1' through the unit 185 are set with respect to the rotational angle of the cam, as shown in FIG. 16.

The difference $\Delta p$ can be adjusted by controlling the fuel pressure in the tank 181 by opening/closing the valve 184. Thus, if the fuel pressure in the tank 181 is increased, the fuel quantity introduced into the chamber 22 can also be increased. Conversely, if the fuel pressure in the tank 181 is decreased, the fuel quantity introduced into the chamber 22 can be decreased.

Therefore, according to the fuel injection apparatus of the sixth embodiment, fuel introduced from the pump 160 to the chamber 42 of the injector 1', i.e., the fuel injection quantity can be controlled by the pump 160 itself, and when the fuel quantity introduced into the chamber 22 is adjusted by the device 180, the fuel injection timing can be controlled. Furthermore, according to the sixth embodiment, since the tank 181 does not always communicate with the chamber 22 of the injector 1' through the unit 185, a change in fuel pressure in the tank 181 can be satisfactorily eliminated. As a result, since the fuel pressure in the tank 181 can be controlled at a desired level, the fuel quantity to be introduced into the chamber 22 can be controlled with high precision. In other words, the fuel injection timing can be very precisely controlled.

Figure 17:
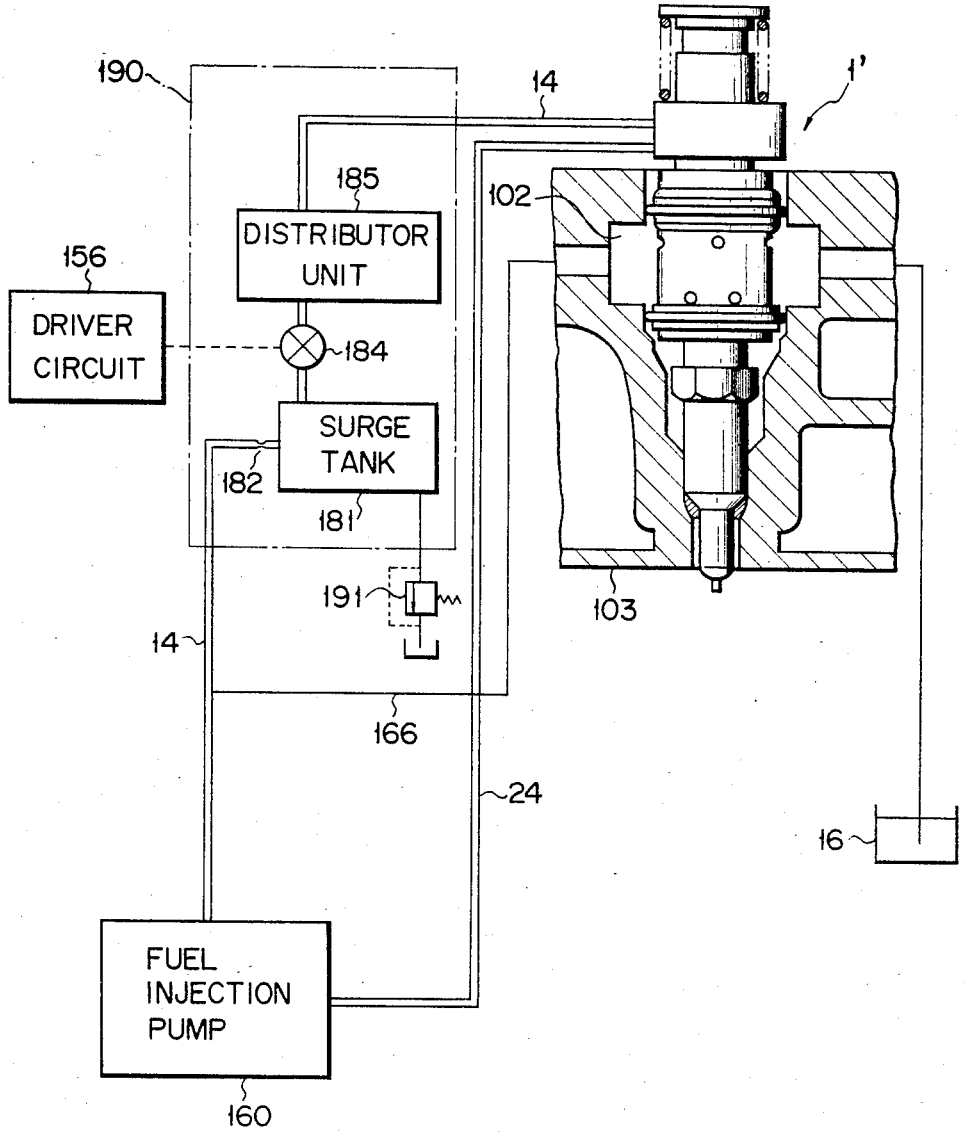
FIG. 17 is a schematic view of a fuel injection apparatus according to a seventh embodiment of the present invention.
Figure 18:
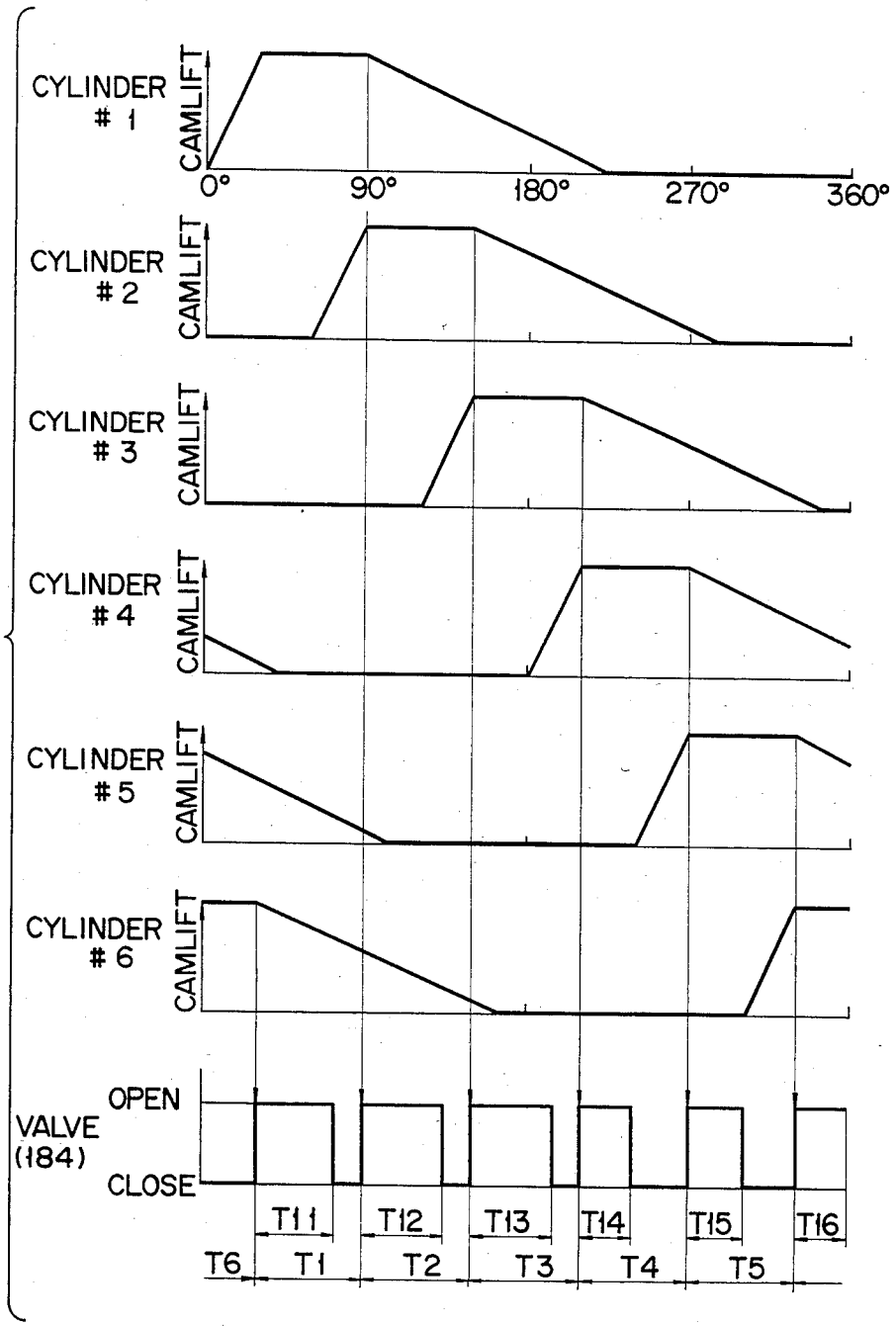
FIG. 18 is a timing chart showing the operation of the distribution unit of the fuel injection apparatus shown in FIG. 17.

FIG. 17 shows a fuel injection apparatus according to a seventh embodiment of the present invention. FIG. 17 shows a state wherein a unit injector 1' is installed on a cylinder head 103 and a fuel gallery 164 of the injector 1' is connected to a head gallery 102, as in the third embodiment shown in FIG. 9. The apparatus of the seventh embodiment comprises a distribution device 190 having the same function as that of the device 180 of the sixth embodiment. In the device 190, a surge tank 181 is connected to a fuel tank 16 through a path in which a pressure adjusting valve 191 is inserted. The valve 191 maintains a constant fuel pressure in the tank 181. Note that if the tank 181 has a sufficiently large volume and the fuel pressure in the tank 181 can be maintained at a constant level, the valve 191 can be omitted. The above-mentioned solenoid operated valve 184 is arranged in a path between the tank 181 and the unit 185.

According to the distribution device 190 of the seventh embodiment, in the above-mentioned relation $q=\alpha\cdot A\sqrt{2g\cdot\Delta p/r}\cdot T$, only the connection interval T is a variable. Therefore, when the connection interval T is adjusted by opening/closing the valve 184, the fuel quantity introduced into the chamber 22, i.e., the fuel injection timing can be controlled in the same manner as in the sixth embodiment. FIG. 17 shows the connection intervals $T_{11}$ to $T_{16}$ between the tank 181 and the chambers 22 of the first to sixth injectors 1' through the unit 185 determined by the valve 184. As is apparent from FIG. 17, the opening timing of the valve 184 coincides with the connection timing of the hole 191 and the chamber 192 in the unit 185.

Figure 19:
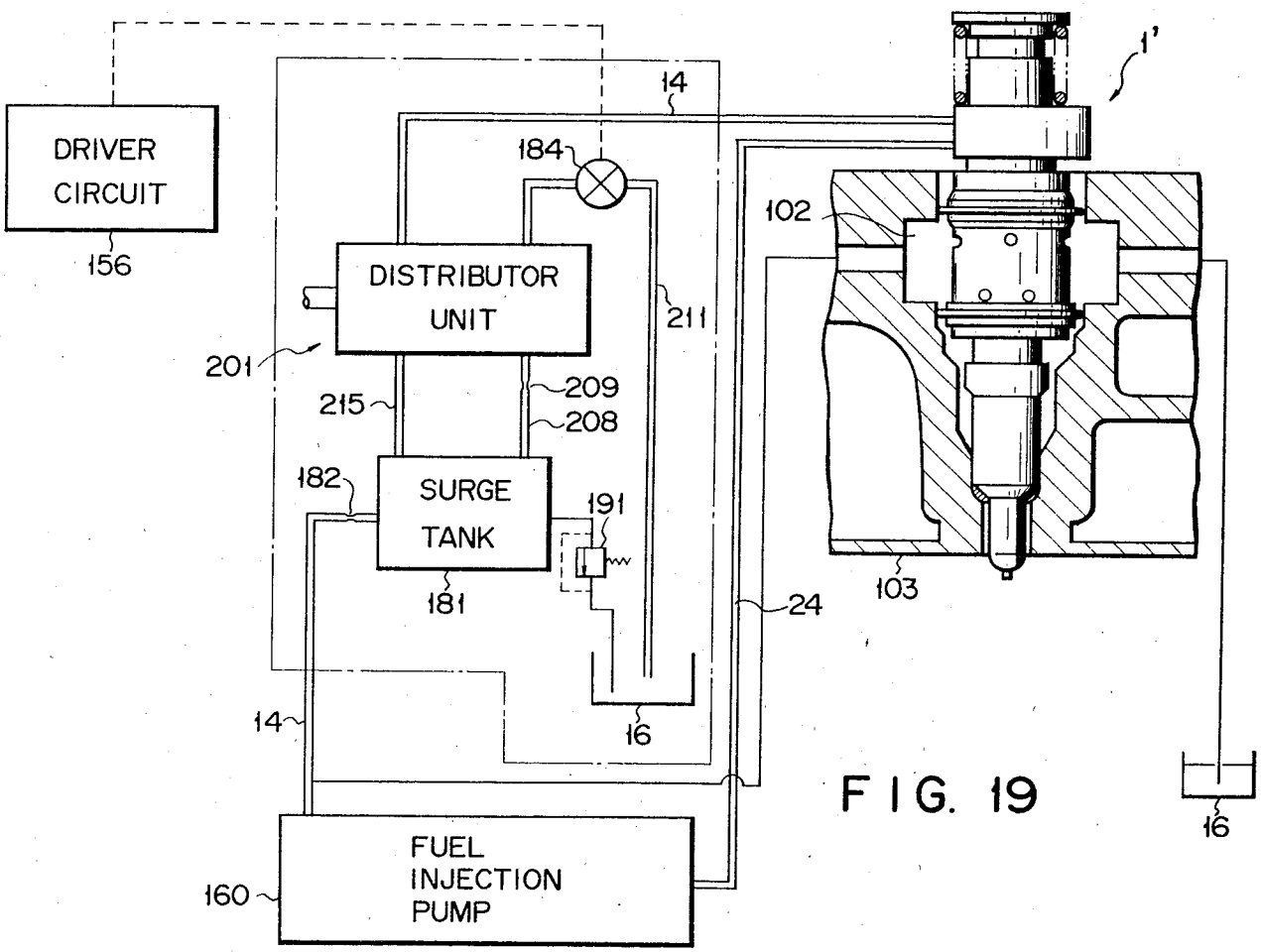
FIG. 19 is a schematic view of a fuel injection apparatus according to an eighth embodiment of the present invention.
Figure 20:
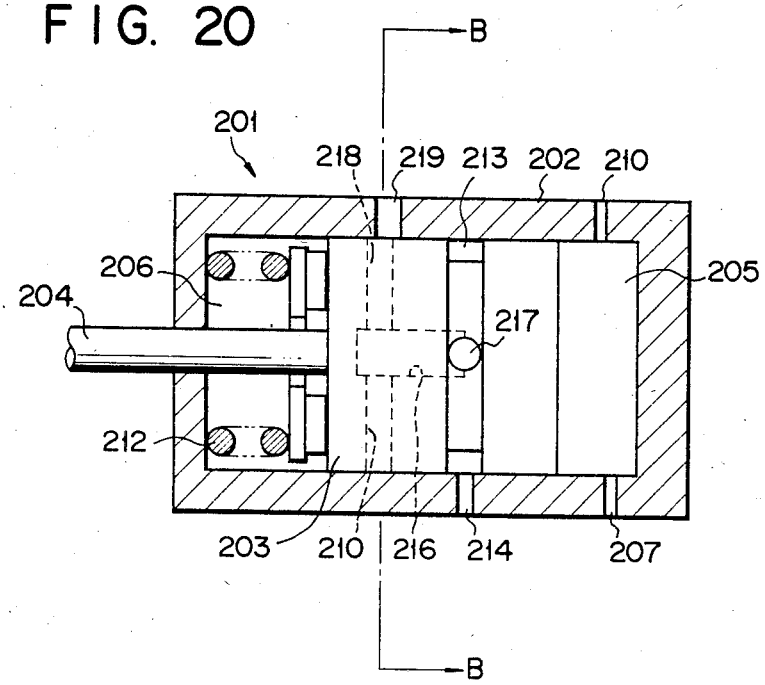
FIG. 20 is a sectional view showing the distribution unit of FIG. 19.
Figure 21:
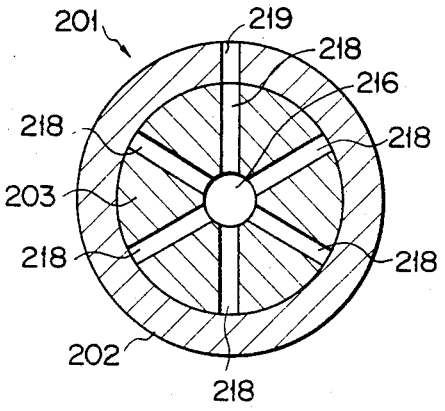
FIG. 21 is a sectional view taken along a line B—B in FIG. 20.

FIGS. 19 to 21 show a fuel injection apparatus according to an eighth embodiment of the present invention. The apparatus of the eighth embodiment comprises still another distribution device 200. The device 200 has a surge tank 181 comprising a pressure adjusting valve 191, as in the sixth embodiment shown in FIG. 13. The tank 181 is connected to a distributor unit 201 which is different from the distributor unit 185 of the sixth embodiment shown in FIGS. 14 and 15. FIGS. 20 and 21 show the unit 201 in detail. The unit 201 comprises a unit cylinder 202. A piston 203 is slidably and rotatably fitted in the cylinder 202. The piston 203 is integrally coupled to a rotating shaft 204, and is rotated at half the engine speed in the same manner as in the above-mentioned rotor 187. In the cylinder 202, a pressure chamber 205 and a spring chamber 206 are defined by two ends of the piston 203. The chamber 206 is connected to the tank 181 through a hole 207 and a path 208 formed in the cylinder 202. A stricture 209 is provided midway along the path 208. The chamber 206 is connected to the tank 16 through a hole 210 and a return path 211 formed in the cylinder 202. A solenoid operate valve 184 is inserted midway along the path 211.

A spring 212 is stored in the chamber 206, and determines the position of the piston 203 along its axial direction.

An annular groove 213 is formed in the piston 203, and is connected to the tank 181 through a hole 214 and a path 215 formed in the cylinder 202. The groove 213 is also connected to a bore 216 formed in the piston 203 along the axial direction through a lateral hole 217. Six radial holes 218, each having one end connected to the bore 216 and the other end open to the outer peripheral surface of the piston 203, are formed in the piston 203. Openings of the holes 218 are arranged in the outer peripheral surface at equal intervals in the circumferential direction. A connecting hole 219 which is sequentially coupled to the holes 218 upon rotation of the piston 203 is formed in the cylinder 202, and is connected to the timing chamber 22 of the injector 1' through the path 14. Note that in FIG. 19, only a single path 14 connected to the hole 19 is shown. However, in the eighth embodiment, the path 14 is branched so as to correspond to the number of engine cylinders, and the branches are connected to the respective chambers 22 of the unit injector 1'.

In the device 200, fuel in the tank 181 is supplied to the chamber 22 of the injector 1' through the path 215, the hole 214, the groove 213, the hole 217, the bore 216, the holes 218 and 219 and the path 14 every time one of the holes 218 is connected to the hole 219 of the cylinder 202 upon rotation of the piston 203. In the device 200 of the eighth embodiment, the fuel quantity q supplied to the chamber 22 can be calculated by the above-mentioned relation $q=\alpha\cdot A\sqrt{2g\cdot\Delta p/r}\cdot T$. However, in this embodiment, A is a variable. Therefore, in this embodiment, when the path cross-sectional area A is varied, the fuel quantity supplied to the chamber 22 can be controlled. That is, fuel is supplied from the tank 181 to the pressure chamber 205 of the unit 201 through the path 208 and the portion 209. Since the valve 184 is provided in the path 211 connected to the chamber 205, the fuel pressure in the chamber 205 can be controlled when the open/close operation of the valve 184 is controlled. Therefore, when the piston 203 is moved against the biasing force of the spring 212 by the pressure of the chamber 205, a connection area between the hole 218 of the piston 203 and the hole 219 of the cylinder 202, i.e., the cross-sectional area A can be varied, as shown in FIG. 21. In the eighth embodiment, the fuel quantity introduced into the chamber 22, i.e., the fuel injection timing can be controlled by controlling the open/close timing of the valve 184.

In the sixth to eighth embodiments, the solenoid operated valve 184 is used for controlling the fuel injection timing; however, high fuel pressure at the side of the unit injector 1' is not applied to the valve 184.

What is claimed is:

1. A fuel injection apparatus for supplying fuel from a fuel tank to at least one combustion chamber of an internal combustion engine, comprising:

an injector housing defining therein a pressure cylinder bore, an injection cylinder bore and a timing cylinder bore connected in series with the pressure cylinder bore;

a pressure plunger, fitted in the pressure cylinder bore and having one end defining, in the pressure cylinder bore, a pressure pump chamber communicating with the injection cylinder bore and the timing cylinder bore;

first fuel supply means for supplying fuel from said fuel tank to said pressure pump chamber;

pressurizing means for reciprocating said pressure plunger in the pressure cylinder bore in synchronism with the engine operation so as to pressurize fuel in said pressure pump chamber;

an injection plunger, having a diameter smaller than said pressure plunger, fitted in the injection cylinder bore and having two ends defining, in the injection cylinder bore, an injection pump chamber and a first communicating chamber communicating with said pressure pump chamber;

second fuel supply means for adjusting the quantity of the fuel from said fuel tank in accordance with engine operation conditions so as to supply the adjusted fuel quantity to said injection pump chamber;

injection valve means for injecting the fuel into said fuel pump chamber toward a combustion chamber of the engine when the pressure in said pressure pump chamber is applied to said injection plunger through said first communicating chamber, and the fuel pressure in said injection pump chamber reaches a predetermined injection pressure;

a timing plunger fitted in the timing cylinder bore and having two ends defining, in the timing cylinder bore, a timing chamber and a second communicating chamber communicating with said pressure pump chamber;

third fuel supply means for adjusting the quantity of fuel from said fuel tank in accordance with the engine operation conditions so as to supply the adjusted fuel quantity to said timing chamber; and relief means for relieving the fuel in said timing chamber, said relief means having a relief path coupled to said timing chamber and a relief valve, disposed in said relief path, for opening said relief path when the pressure in said pressure pump chamber is applied to said timing plunger through said second communicating chamber, and a fuel pressure in said timing chamber reaches a predetermined relief pressure by said timing plunger, the relief pressure being set lower than the injection pressure.

2. An apparatus according to claim 1, wherein said third fuel supply means includes a first path for connecting said timing chamber and said fuel tank; a first fuel pump, arranged in said first path, for supplying fuel from said fuel tank to said timing chamber; a check valve, arranged in said first path between said first fuel pump and said timing chamber; and a solenoid operated valve, arranged in said first path between said check valve and said first fuel pump, for adjusting the quantity of fuel supplied to said timing chamber.

3. An apparatus according to claim 2, wherein said second fuel supply means includes an annular groove formed in an outer peripheral surface of said timing plunger; a second path having one end continuously connected to said annular groove irrespective of an axial position of said timing plunger in said timing cylinder bore, and the other end connected to said fuel tank; a second fuel pump, arranged in said second path, for supplying fuel from said fuel tank to said annular groove, the fuel pressure supplied from said second pump being set lower than that from said first fuel pump; a timing path, defined in said injector housing and having one end connected to said injection pump chamber and the other end open to an inner peripheral surface of said timing cylinder bore, an opening of said timing path being positioned to communicate with said annular groove before fuel is supplied from said first pump chamber to said timing chamber, but to be closed by said timing plunger after fuel is supplied from said first fuel pump to said timing chamber and said timing plunger is moved; and a check valve, arranged midway along said timing path, for opening a path toward said injection pump chamber, the quantity of fuel supplied to said injection pump chamber being controlled by a valve opening timing of said solenoid operated valve, and the quantity of fuel supplied to said timing chamber being controlled by a valve closing timing of said solenoid operated valve.

4. An apparatus according to claim 3, wherein said injection plunger has an annular groove formed on its outer peripheral surface thereof and a connecting hole, formed in said injection plunger, for connecting said injection pump chamber and said annular groove, a path being defined in said injector housing for connecting said annular groove to said timing path when fuel supply from said injection pump chamber is completed.

5. An apparatus according to claim 3, wherein said first fuel supply means includes a branch path branched from said second path and open to the inner peripheral surface of said pressure supply cylinder bore, the opening of said branch path being positioned so as to be connected to said pressure supply pump chamber after said pressure supply plunger is moved a given distance in a direction for increasing a volume of said pressure supply pump chamber.

6. An apparatus according to claim 5, wherein said first path includes a fuel gallery defined in said injector housing, and said branch path is connected to said fuel gallery.

7. An apparatus according to claim 3, wherein said first and second fuel pumps constitute a unit as a single distributor type fuel supply device for distributing fuel to respective combustion chambers of the engine, said distributor type fuel supply device comprising a housing in which a fuel supply chamber is defined, a feed pump for supplying fuel from said fuel tank to said fuel supply chamber, distribution pump means for further pressurizing fuel in said fuel supply chamber so as to distribute the pressurized fuel to the respective combustion chambers, adjusting means for adjusting the quantity of fuel supplied from said distribution pump means in accordance with the engine operation conditions, and timing control means for controlling a supply timing of fuel supplied from the distribution pump means in accordance with the engine operation conditions, said first path being connected to said distribution pump means and said second path being connected to said fuel supply chamber.

8. An apparatus according to claim 1, wherein said second fuel supply means includes a third path for connecting said injection pump chamber and said fuel tank; a third fuel pump, arranged in said third path, for supplying fuel from said fuel tank to said injection pump chamber; a check valve, arranged in said third path between said third fuel pump and said injection pump chamber; and a solenoid operated valve, arranged in said third path between said check valve and said third fuel pump, for adjusting the quantity of fuel supplied to said injection pump chamber.

9. An apparatus according to claim 8, wherein said third fuel supply means includes an annular groove formed in an outer peripheral surface of said injection plunger; a fourth path having one end continuously connected to said annular groove irrespective of the axial position of said injection plunger in said injection cylinder bore, and the other end connected to said fuel tank; a fourth fuel pump, arranged in said fourth path, for supplying fuel from said fuel tank to said annular groove, the pressure of fuel supplied from said fourth fuel pump being set lower than that from said third fuel pump; a timing path, defined in said injector housing and having one end connected to said timing chamber and the other end open to an inner peripheral surface of said injection cylinder bore, an opening of said timing path being positioned so as to communicate with said annular groove before fuel is supplied from said third fuel pump to said injection pump chamber, but to be closed after fuel is supplied from said third fuel pump to said injection pump chamber and said injection plunger is moved; and a check valve, arranged midway along said timing path, for opening a path toward said timing chamber, the quantity of fuel supplied to said timing chamber being controlled by the valve opening timing of said solenoid operated valve, and the quantity of fuel supplied to said injection pump chamber being controlled by the valve closing timing of said solenoid operated valve.

10. An apparatus according to claim 9, wherein said third and fourth pumps constitute a unit as a single distributor type fuel supply device for distributing fuel to respective combustion chambers of the engine, said distributor type fuel supply device including a housing in which a fuel supply chamber is defined, a feed pump for supplying fuel from said fuel tank to said fuel supply chamber, distribution pump means for further pressurizing fuel in said fuel supply chamber so as to distribute the pressurized fuel to the respective combustion chambers, adjusting means for adjusting the quantity of fuel supplied from said distribution pump means in accordance with the engine operation conditions, and timing control means for controlling the supply timing of fuel supplied from said distribution pump means in accordance with the engine operating conditions, said third path being connected to said distribution pump means and said fourth path being connected to said fuel supply chamber.

11. An apparatus according to claim 1, wherein said second and third fuel supply means constitute a distributor type fuel supply device for distributing fuel to respective combustion chambers of the engine, said distributor type fuel supply device including distributor type fuel supply means having a housing in which a fuel supply chamber is defined, a feed pump for supplying fuel from said fuel tank to said fuel supply chamber, distribution pump means for further pressurizing fuel in said fuel supply chamber so as to distribute the pressurized fuel to the respective combustion chambers of the engine, adjusting means for adjusting a quantity of fuel supplied from said distribution pump means in accordance with the engine operating conditions, a fifth path for connecting said distribution pump means of said distributor type fuel supply device to said injection pump chamber, a check valve arranged in said fifth path, a sixth path for connecting said fuel supply chamber of said distributor type fuel supply device to said timing chamber, and control means for controlling fuel supplied from said fuel supply chamber to said timing chamber through said sixth path in accordance with the engine operating conditions.

12. An apparatus according to claim 11, wherein said control means includes a surge tank, arranged midway along said sixth path, to which fuel in said fuel supply chamber is supplied; a return path for connecting said surge tank and said fuel tank; a solenoid operated valve, arranged in said return path, for adjusting the fuel pressure in said surge tank; and a distribution unit, provided in said sixth path at a downstream side of said surge tank, for delivering fuel in said surge tank to said sixth path, said distribution unit having a unit housing and a rotor, said unit housing having a cylinder bore defined therein and a plurality of outlet holes arranged at equal intervals in a circumferential direction in an inner surface thereof, one of which is connected to said sixth path; said rotor being rotatably arranged in said unit housing and rotated at a predetermined rotational speed, said rotor having both an introduction chamber defined in its central portion to receive fuel from said surge tank, and radial holes, each of which has one end connected to said introduction chamber and the other end open to the outer peripheral surface of said rotor, these holes being sequentially connected to said outlet holes upon rotation of said rotor.

13. An apparatus according to claim 11, wherein said control means includes a surge tank, arranged midway along said sixth path, for accumulating fuel from said fuel supply chamber at a constant pressure;

a distribution unit, arranged in said sixth path at a downstream side of said surge tank, for delivering fuel in said surge tank to said sixth path at the side of said timing chamber, said distribution unit having a unit housing and a rotor, said unit housing having a cylinder bore defined therein and a plurality of outlet holes arranged at equal intervals in a circumferential direction in an inner surface thereof, one of which is connected to said sixth path; said rotor being rotatably arranged in said unit housing and rotated at a predetermined rotational speed, said rotor having both an introduction chamber defined in its central portion to receive fuel from said surge tank, and radial holes, each of which has one end connected to said introduction chamber and the other end open to the outer peripheral surface of said rotor, these holes being sequentially connected to said outlet holes upon rotation of said rotor; and a solenoid operated valve, arranged in said sixth path for connecting said surge tank and said distribution unit, for controlling the opening timing of said sixth path.

14. An apparatus according to claim 11, wherein said control means includes a surge tank, arranged midway along said sixth path, for accumulating fuel from said fuel supply chamber at a constant pressure; and a distribution unit, arranged in said sixth path at a downstream side of said surge tank, for delivering fuel in said surge tank to said sixth path at the side of said timing chamber, said distribution unit having a unit cylinder in which one outlet hole connected to said sixth path at the side of said timing chamber is formed; a piston rotatably fitted in said unit cylinder and rotated at a predetermined rotating speed, a pressure chamber and a spring chamber being defined in said unit cylinder by two ends of said piston, the pressure chamber receiving fuel from said surge tank; said piston having an introduction chamber defined in a central portion of said piston and receiving fuel from said surge tank, and a plurality of radial holes, each of which has one end connected to said introduction chamber and the other end open to an outer peripheral surface of said piston at equal intervals in a circumferential direction, these holes being sequentially connected to said outlet hole upon rotation of said piston; a spring, housed in said spring chamber and capable of biasing said piston against said pressure chamber; a return path for connecting said pressure chamber and said fuel tank; and a solenoid operated valve, arranged in said return path, for adjusting the pressure of fuel in said pressure chamber, said piston receiving the pressure of said pressure chamber and being moved in the axial direction against the biasing force of said spring, thereby varying the connection area of said radial hole and said outlet hole.

15. An apparatus according to claim 1, wherein said relief valve comprises a check valve having a valve member biased by a spring.

* * * * *